US012709357B2

(12) United States Patent
Giroux et al.

(10) Patent No.: US 12,709,357 B2
(45) Date of Patent: Aug. 18, 2026

(54) RETRACTABLE LIFT-PROPULSION SYSTEM FOR A WATERCRAFT AND WATERCRAFT HAVING SAME

(71) Applicant: BOMBARDIER RECREATIONAL PRODUCTS INC., Valcourt (CA)

(72) Inventors: Francois Giroux, Valcourt (CA); Daniel Mercier, Magog (CA); Chadley Jaziri, Rockledge, FL (US); Francis Cloutier, Sherbrooke (CA); Alexandre Lecointre, Sherbrooke (CA); Denys Lapointe, St-Bruno-de-Montarville (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 525 days.

(21) Appl. No.: 18/250,858

(22) PCT Filed: Oct. 29, 2021

(86) PCT No.: PCT/IB2021/060054

§ 371 (c)(1),
(2) Date: Apr. 27, 2023

(87) PCT Pub. No.: WO2022/091035

PCT Pub. Date: May 5, 2022

(65) Prior Publication Data

US 2023/0382496 A1 Nov. 30, 2023

Related U.S. Application Data

(60) Provisional application No. 63/107,564, filed on Oct. 30, 2020.

(51) Int. Cl.
*B63B 1/30* (2006.01)
*B63B 1/24* (2020.01)
(Continued)

(52) U.S. Cl.
CPC ..... *B63B 1/30* (2013.01); *B63B 1/246* (2013.01); *B63B 1/26* (2013.01); *B63B 34/10* (2020.02);
(Continued)

(58) Field of Classification Search
CPC .. B63B 1/30; B63B 1/246; B63B 1/26; B63B 34/40; B63B 34/10; B63H 21/17; B63H 21/213; B63H 2021/216
See application file for complete search history.

(56) References Cited

U.S. PATENT DOCUMENTS 2,749,870 A * 6/1956 Vavra ..... B63B 1/246 114/282
4,953,492 A 9/1990 Duffy
(Continued)

FOREIGN PATENT DOCUMENTS

CN 108945334 A 12/2018
WO 2020042302 A1 3/2020
(Continued)

OTHER PUBLICATIONS

The third party observation submission letter dated Jun. 21, 2024, filed in the European Patent Office during the prosecution of corresponding application No. 21885494.1.
(Continued)

*Primary Examiner* — Stephen P Avila
(74) *Attorney, Agent, or Firm* — BCF LLP

(57) ABSTRACT

A watercraft has a retractable lift-propulsion system including a mast connected to a buoyant body of the watercraft and movable between retracted and deployed positions. A distance between a distal end of the mast and a lower surface of the buoyant body is greater in the deployed position than in the retracted position. A lift-propulsion assembly includes a hydrofoil for providing lift to the watercraft at least in the
(Continued)

deployed position of the mast and a propulsion unit for providing thrust to the watercraft in the retracted and deployed positions of the mast. The lift-propulsion assembly is connected to the distal end of the mast such that, in the deployed position of the mast, the lift-propulsion assembly is distanced from the buoyant body of the watercraft and, in the retracted position of the mast, the lift-propulsion assembly is proximate the buoyant body of the watercraft.

20 Claims, 34 Drawing Sheets

(51) Int. Cl.

| | |
|---|---|
| ***B63B 1/26*** | (2006.01) |
| ***B63B 34/10*** | (2020.01) |
| ***B63B 34/40*** | (2020.01) |
| ***B63H 21/17*** | (2006.01) |
| ***B63H 21/21*** | (2006.01) |

(52) U.S. Cl.
CPC ..... *B63B 34/40* (2020.02); *B63H 21/17* (2013.01); *B63H 21/213* (2013.01); *B63H 2021/216* (2013.01)

(56) References Cited

U.S. PATENT DOCUMENTS

| | | | |
|---|---|---|---|
| 5,117,776 | A | 6/1992 | Thorpe |
| 5,125,858 | A | 6/1992 | Salvetti |
| 7,232,350 | B1 | 6/2007 | Krah |
| 8,398,446 | B2 | 3/2013 | Railey et al. |
| 8,851,947 | B2 | 10/2014 | Vlock et al. |
| 9,359,044 | B2 | 6/2016 | Langelaan |
| 9,586,659 | B2 | 3/2017 | Langelaan |
| 10,000,266 | B1 | 6/2018 | Terada |
| 10,035,570 | B1 | 7/2018 | Barron |
| 10,099,754 | B2 | 10/2018 | Tian |
| 10,279,873 | B2 | 5/2019 | Logosz |
| 10,358,193 | B2 | 7/2019 | Lobisser |
| 10,358,194 | B1 | 7/2019 | Wengreen et al. |
| 10,363,998 | B2 | 7/2019 | Terada |
| 10,486,771 | B2 | 11/2019 | Tian |
| 10,532,793 | B2 | 1/2020 | Lagarrigue et al. |
| 10,597,118 | B2 | 3/2020 | Montague et al. |
| 10,625,834 | B2 | 4/2020 | MacFarlane |
| 2011/0056423 | A1 | 3/2011 | Railey |
| 2011/0201238 | A1 | 8/2011 | Rott et al. |
| 2017/0283015 | A1 | 10/2017 | Langelaan |
| 2017/0341718 | A1 | 11/2017 | Zimmerman et al. |
| 2019/0106179 | A1 | 4/2019 | Ulgen |
| 2019/0168851 | A1 | 6/2019 | Tian |
| 2019/0233063 | A1 | 8/2019 | Geislinger |
| 2019/0367132 | A1 | 12/2019 | Montague et al. |
| 2020/0079479 | A1* | 3/2020 | Derrah ..... B63H 1/16 |
| 2022/0363351 | A1 | 11/2022 | Rosen |
| 2022/0380000 | A1 | 12/2022 | Rosen |
| 2022/0388607 | A1 | 12/2022 | Rosen |

FOREIGN PATENT DOCUMENTS

| | | | |
|---|---|---|---|
| WO | 2021084127 | A1 | 5/2021 |
| WO | 2021084128 | A1 | 5/2021 |

OTHER PUBLICATIONS

The European Search Report and Opinion issued from the European Patent Office on Sep. 11, 2024, during the prosecution of corresponding application EP 21885494.1.

* cited by examiner

RETRACTABLE LIFT-PROPULSION SYSTEM FOR A WATERCRAFT AND WATERCRAFT HAVING SAME

CROSS-REFERENCE

The present application claims priority from U.S. Provisional Patent Application No. 63/107,564, filed Oct. 30, 2020, the entirety of which is incorporated by reference herein.

FIELD OF TECHNOLOGY

The present technology relates to lift-propulsion systems for watercraft.

BACKGROUND

Surfboards are sometimes equipped with a hydrofoil to provide lift thereto, notably raising a running surface of the surfboard from the water to reduce drag. In addition to a hydrofoil, surfboards can also be equipped with a propulsion unit which provides thrust to the surfboard and thereby reduces user effort during operation of the surfboard.

Although hydrofoil and propulsion units can be useful, their construction can also limit the operation of the surfboard. For instance, typically, a surfboard equipped with a hydrofoil cannot be used in water that is shallower than the distance between the hydrofoil and the surfboard (i.e., the surfboard must be used in water that is at least as deep as the vertical position of the hydrofoil below the surfboard will allow). This can restrict the surfboard from being launched from various locations including beaches and docks. Moreover, a surfboard equipped with a hydrofoil is often cumbersome and difficult to transport and store.

To address these issues, some hydrofoil-equipped surfboards have been designed to be disassembled. For instance, in some cases, the hydrofoil and a strut connecting it to the body of a surfboard can be removed from the rest of the surfboard. However, for surfboards equipped with both a hydrofoil and a propulsion unit mounted below the body of the surfboard, such disassembly can also require disconnecting the propulsion unit from a power source provided on the body of the board. This can make the disassembly complex and time consuming and may also require additional preparation by the user to assemble or disassemble the hydrofoil and propulsion unit before using the surfboard as it may not be easy or even feasible to assemble or disassemble the components when out in a body of water.

While the above issues have been discussed relative to surfboards, this also applies to different types of watercraft that can be outfitted with a hydrofoil and a propulsion unit.

In view of the foregoing, there is a need for a watercraft with a lift-propulsion system that addresses at least some of these drawbacks.

SUMMARY

It is an object of the present technology to ameliorate at least some of the inconveniences present in the prior art.

According to an aspect of the present technology, there is provided a watercraft. The watercraft has a buoyant body and a retractable lift-propulsion system. The buoyant body has upper and lower surfaces on respective upper and lower sides thereof. The retractable lift-propulsion system includes a mast connected to the buoyant body, the mast having a proximal end and a distal end, the mast being movable between a retracted position and a deployed position. The mast extends from the lower side of buoyant body in the deployed position. A distance between the distal end of the mast and the lower surface of buoyant body is greater in the deployed position than in the retracted position. The retractable lift-propulsion system also includes a lift-propulsion assembly. The lift-propulsion assembly includes: a hydrofoil for providing lift to the watercraft at least in the deployed position of the mast; and a propulsion unit for providing thrust to the watercraft in the retracted and deployed positions of the mast. The lift-propulsion assembly is connected to the distal end of the mast such that, in the deployed position of the mast, the lift-propulsion assembly is distanced from the buoyant body of the watercraft and, in the retracted position of the mast, the lift-propulsion assembly is proximate the buoyant body of the watercraft.

In some embodiments, the mast pivots between the retracted position and the deployed position.

In some embodiments, the hydrofoil comprises a front foil and a rear foil disposed rearward of the front foil.

In some embodiments, the lift-propulsion assembly further comprises an electric motor for driving the propulsion unit.

In some embodiments, the retractable lift-propulsion system also includes an electrical assembly supported by the buoyant body, the electrical assembly including: a battery for powering the electric motor; and an inverter in electrical communication between the battery and the electric motor.

In some embodiments, the electric motor is electrically connected to the electrical assembly via wires extending within the mast.

In some embodiments, the buoyant body defines a chamber accessible from the upper side of the buoyant body; and the chamber houses the electrical assembly.

In some embodiments, the propulsion unit comprises one of a propeller and an impeller.

In some embodiments, the propulsion unit includes a ducted impeller.

In some embodiments, the lower surface of the buoyant body defines a recess; and the recess is shaped complementarily to a shape of the lift-propulsion assembly such that the lift-propulsion assembly is at least partially received in the recess in the retracted position of the mast.

In some embodiments, the recess includes a portion which, in the retracted position, extends in front of the propulsion unit to promote flow of water to the propulsion unit.

In some embodiments, the lift-propulsion assembly also includes a frame pivotably connected to the distal end of the mast, the hydrofoil and the propulsion unit being connected to the frame; the retractable lift-propulsion system also includes: an inner housing at least partially enclosed by and connected to the buoyant body of the watercraft, the mast being pivotably connected to the inner housing; and a mast assembly including: the mast; the inner housing; the frame of the lift-propulsion assembly; and a link pivotably connected to the frame of the lift-propulsion assembly and to the inner housing, the mast, the inner housing, the frame and the link collaborating to guide movement of the mast between the retracted and deployed positions.

In some embodiments, together, the mast, the inner housing, the frame and the link form a four-bar linkage.

In some embodiments, the mast has a cross-sectional profile that is lacrimiform; and the link extends along a channel defined inside the mast.

In some embodiments, the mast assembly also includes a lever accessible from the upper side of the buoyant body, the lever being movable by an operator of the watercraft to move the mast between the retracted and deployed positions.

In some embodiments, the link is a first link; and the mast assembly also includes a second link connecting the lever to one of the mast and the first link.

In some embodiments, the propulsion unit includes a rotor rotatable about a rotating axis; and the rotating axis remains in a substantially same orientation relative to the buoyant body throughout movement of the mast between the retracted position and the deployed position.

In some embodiments, the propulsion unit comprises a rotor and a duct surrounding the rotor; and the rear foil comprises a first wing and a second wing extending laterally from the duct in generally opposite directions.

In some embodiments, the retractable lift-propulsion system also includes a throttle control for use by an operator of the watercraft, the throttle control being in communication with the electric motor to control driving of the propulsion unit by the electric motor.

In some embodiments, the watercraft also includes a handlebar connected to the buoyant body, the throttle control being disposed on the handlebar.

In some embodiments, the retractable lift-propulsion system further comprises at least one gas strut connected between the buoyant body and the mast to assist in moving the mast from the retracted position to the deployed position.

In some embodiments, the buoyant body is a molded plastic buoyant body.

In some embodiments, the watercraft also includes a flexible panel connected to the buoyant body on the lower side thereof, the flexible panel defining a slit, the mast extending through the slit in the deployed position.

In some embodiments, in the retracted position of the mast, at least a majority of the mast is disposed between the upper and lower surfaces of the buoyant body.

In some embodiments, the lift-propulsion assembly is disposed further rearward in the retracted position of the mast than in the deployed position of the mast.

In some embodiments, the deployed position is a first deployed position; the mast is movable between the retracted position, the first deployed position and a second deployed position; the mast extends from the lower side of the buoyant body in the first deployed position and the second deployed position; the distance between the distal end of the mast and the lower surface of the buoyant body is greater in the first deployed position than in the second deployed position; the hydrofoil provides lift to the watercraft at least in the first deployed position and the second deployed position of the mast; and the propulsion unit provides thrust to the watercraft in the retracted position, the first deployed position and the second deployed position of the mast.

In some embodiments, the propulsion unit includes a rotor rotatable about a rotating axis; and the rotating axis remains in a substantially same orientation relative to the buoyant body throughout movement of the mast between the retracted position, the first deployed position and the second deployed position.

In some embodiments, the hydrofoil comprises a single foil.

In some embodiments, the propulsion unit is disposed below the hydrofoil such that, in the retracted and deployed positions of the mast, a distance between the propulsion unit and the lower surface of the buoyant body is greater than a distance between the hydrofoil and the lower surface of the buoyant body.

In some embodiments, the watercraft is a board.

According to another aspect of the present technology, there is provided a retractable lift-propulsion system for a watercraft. The retractable lift-propulsion system includes: a mast configured to be connected to a buoyant body of the watercraft, and a lift-propulsion assembly. The mast has a proximal end and a distal end. The mast is configured to be moved between a retracted position and a deployed position during use such that: the mast extends from a lower side of the buoyant body in the deployed position, and a distance between the distal end of the mast and the lower surface of the buoyant body is greater in the deployed position than in the retracted position. The lift-propulsion assembly includes: a hydrofoil for providing lift to the watercraft at least in the deployed position of the mast; and a propulsion unit for providing thrust to the watercraft in the retracted and deployed positions of the mast. The lift-propulsion assembly is connected to the distal end of the mast such that, in the deployed position of the mast, the lift-propulsion assembly is distanced from the buoyant body of the watercraft and, in the retracted position of the mast, the lift-propulsion assembly is proximate the buoyant body of the watercraft.

In some embodiments, the mast is configured to pivot between the retracted position and the deployed position.

In some embodiments, the hydrofoil comprises a front foil and a rear foil disposed rearward of the front foil.

In some embodiments, the lift-propulsion assembly also includes an electric motor for driving the propulsion unit.

In some embodiments, the retractable lift-propulsion system also includes an electrical assembly configured to be supported by the buoyant body of watercraft, the electrical assembly including: a battery for powering the electric motor; and an inverter in electrical communication between the battery and the electric motor.

In some embodiments, the electric motor is electrically connected to the electrical assembly via wires extending within the mast.

In some embodiments, the propulsion unit comprises one of a propeller and an impeller.

In some embodiments, the propulsion unit comprises a ducted impeller.

In some embodiments, the lift-propulsion assembly also includes a frame pivotably connected to the distal end of the mast, the hydrofoil and the propulsion unit being connected to the frame; the retractable lift-propulsion system also includes: an inner housing configured to be at least partially enclosed by and connected to the buoyant body of the watercraft, the mast being pivotably connected to the inner housing; and a mast assembly including: the mast; the inner housing; the frame of the lift-propulsion assembly; and a link pivotably connected to the frame of the lift-propulsion assembly and to the inner housing, the mast, the inner housing, the frame and the link collaborating to guide movement of the mast between the retracted and deployed positions.

In some embodiments, together, the mast, the inner housing, the frame and the link form a four-bar linkage.

In some embodiments, the mast has a cross-sectional profile that is lacrimiform; and the link extends along a channel defined inside the mast.

In some embodiments, the mast assembly also includes a lever configured to be accessible from an upper side of the buoyant body, the lever being movable by an operator of the watercraft to move the mast between the retracted and deployed positions.

In some embodiments, the link is a first link; and the mast assembly also includes a second link connecting the lever to one of the mast and the first link.

In some embodiments, the propulsion unit includes a rotor and a duct surrounding the rotor; and the rear foil comprises a first wing and a second wing extending from the duct in generally opposite directions.

In some embodiments, the retractable lift-propulsion system also includes a throttle control for use by an operator of the watercraft, the throttle control being in communication with the electric motor to control driving of the propulsion unit by the electric motor.

In some embodiments, the throttle control is configured to be disposed on a handlebar of the watercraft.

In some embodiments, the retractable lift-propulsion system also includes at least one gas strut configured to be connected between the buoyant body and the mast to assist in moving the mast from the retracted position to the deployed position.

In some embodiments, the deployed position is a first deployed position; the mast is configured to be moved between the retracted position, the first deployed position and the second deployed position during use such that: the mast extends from the lower side of the buoyant body in the first deployed position and the second deployed position, and the distance between the distal end of the mast and the lower surface of the buoyant body is greater in the first deployed position than in the second deployed position; the hydrofoil is configured to provide lift to the watercraft at least in the first deployed position and the second deployed position of the mast; and the propulsion unit is configured to provide thrust to the watercraft in the retracted position, the first deployed position and the second deployed position of the mast.

In some embodiments, the hydrofoil comprises a single foil.

In some embodiments, the propulsion unit is disposed below the hydrofoil such that, during use in the retracted and deployed positions of the mast, a distance between the propulsion unit and the lower surface of the buoyant body is greater than a distance between the hydrofoil and the lower surface of the buoyant body.

Embodiments of the present technology each have at least one of the above-mentioned objects and/or aspects, but do not necessarily have all of them. It should be understood that some aspects of the present technology that have resulted from attempting to attain the above-mentioned objects may not satisfy these objects and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

A watercraft 10 in accordance with an embodiment of the present technology is illustrated in FIGS. 1 to 7. As can be seen, in this embodiment, the watercraft 10 is a surfboard with a lift-propulsion system 50 suspended therebeneath, sometimes referred to as an "eFoil", for riding by an operator. However, the watercraft 10 may be any other suitable type of watercraft in other embodiments (e.g., a wakeboard, a personal watercraft (PWC), etc.).

As will be described in more detail below, in accordance with the present technology, the lift-propulsion system 50 can selectively provide lift and propulsion to the watercraft 10 and is retractable. As will be seen, the retractable lift-propulsion system 50 can be conveniently and easily retracted or deployed at will to accommodate a desired operating mode of the operator of the watercraft 10.

Figure 1:
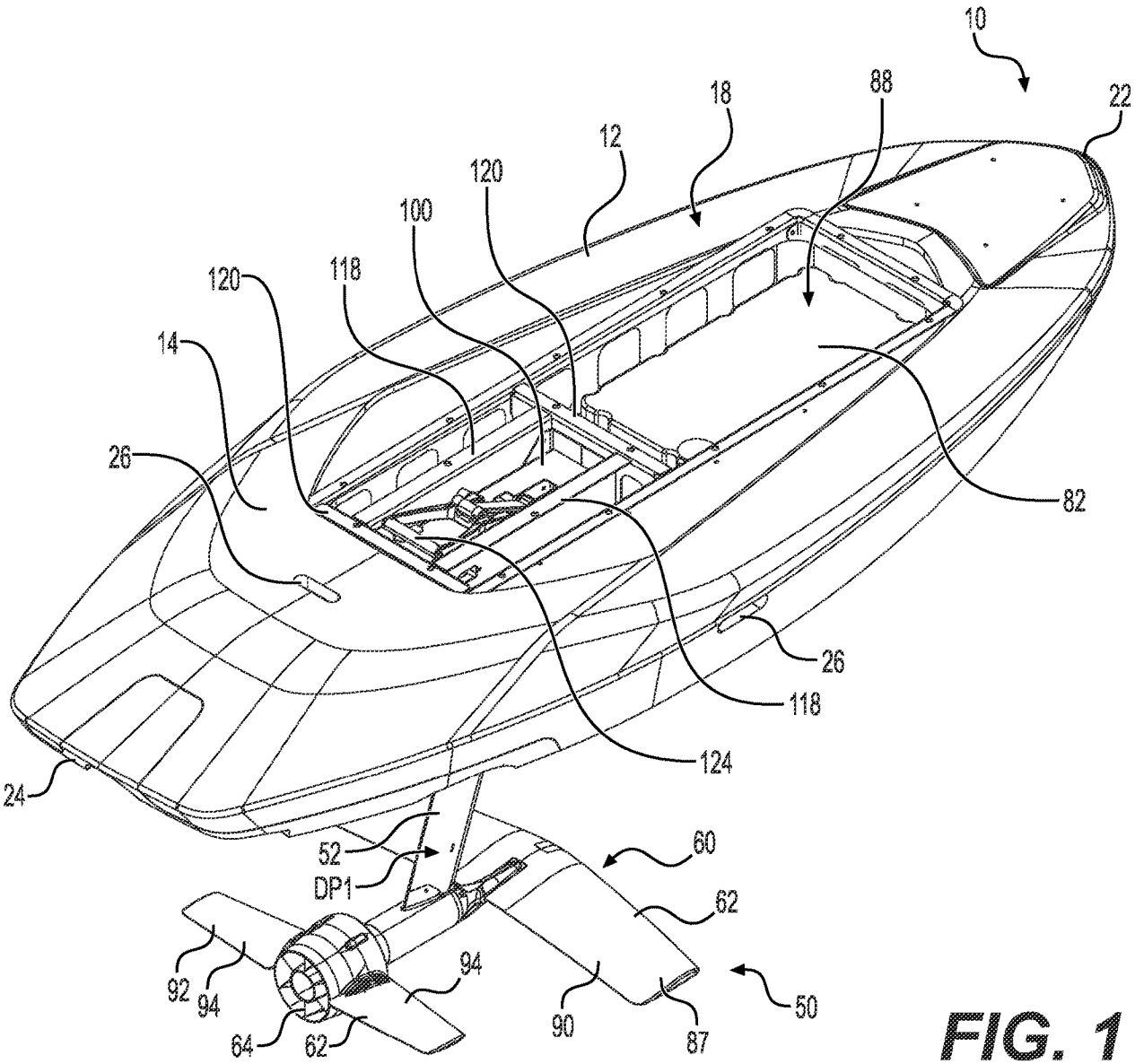
FIG. 1 is a perspective view, taken from a top, rear, right side, of a watercraft according to an embodiment of the present technology, showing a mast of a retractable lift-propulsion system of the watercraft in a fully deployed position thereof.
Figure 2:
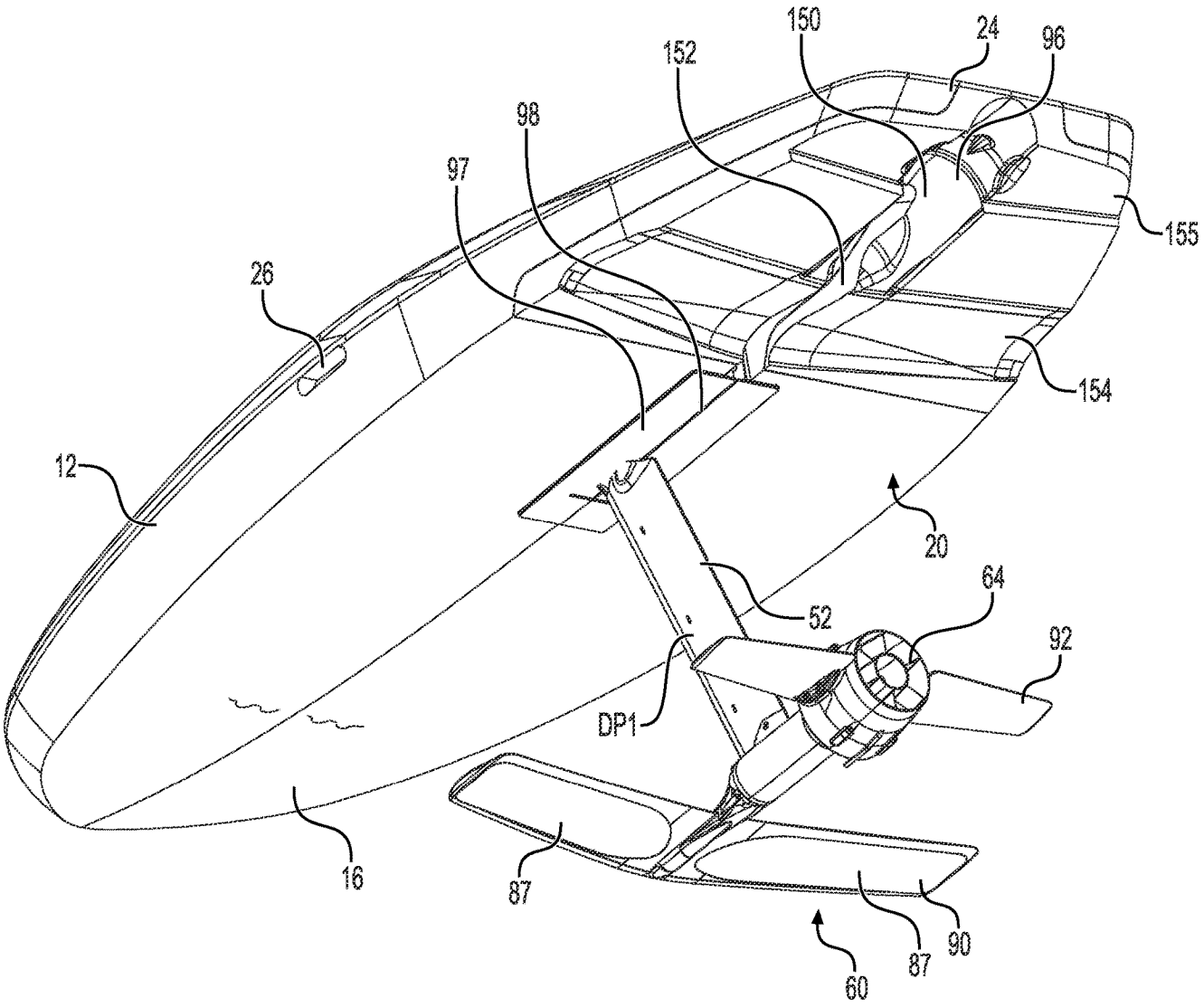
FIG. 2 is a perspective view, taken from a bottom, rear, left side, of the watercraft of FIG. 1.
Figure 3:
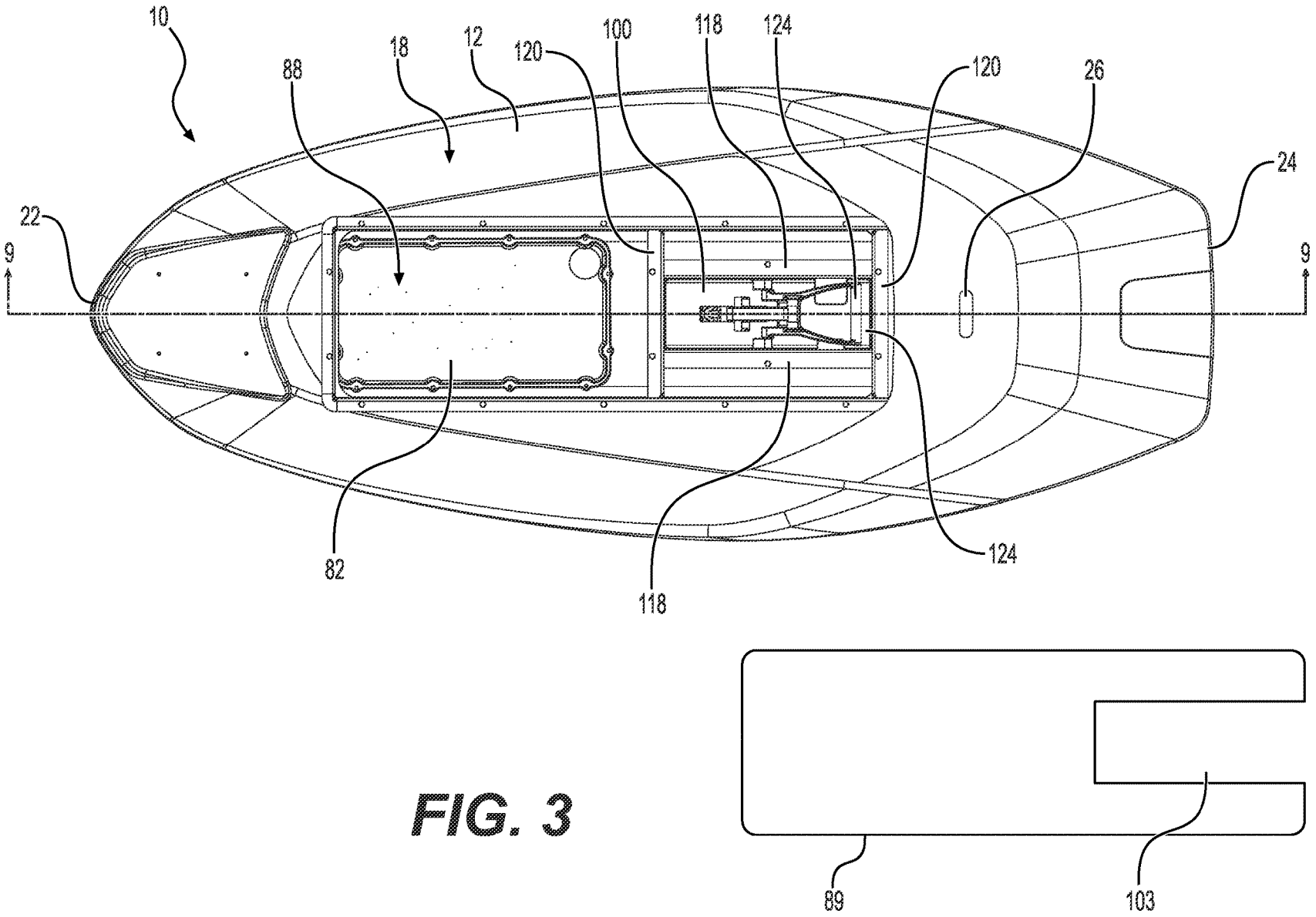
FIG. 3 is a top plan view of the watercraft of FIG. 1, with an access panel shown removed from the watercraft.
Figure 4:
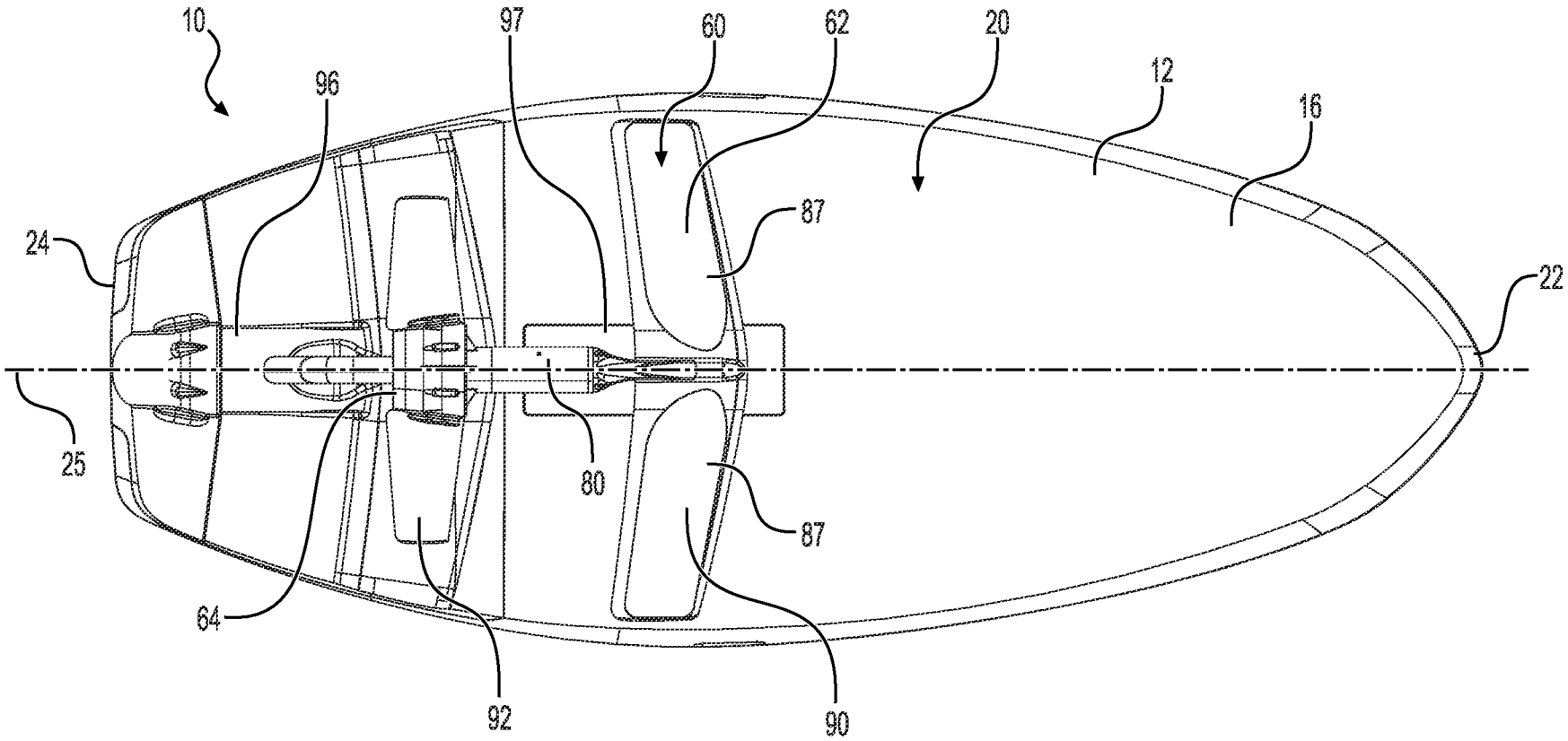
FIG. 4 is a bottom plan view of the watercraft of FIG. 1.
Figure 5:
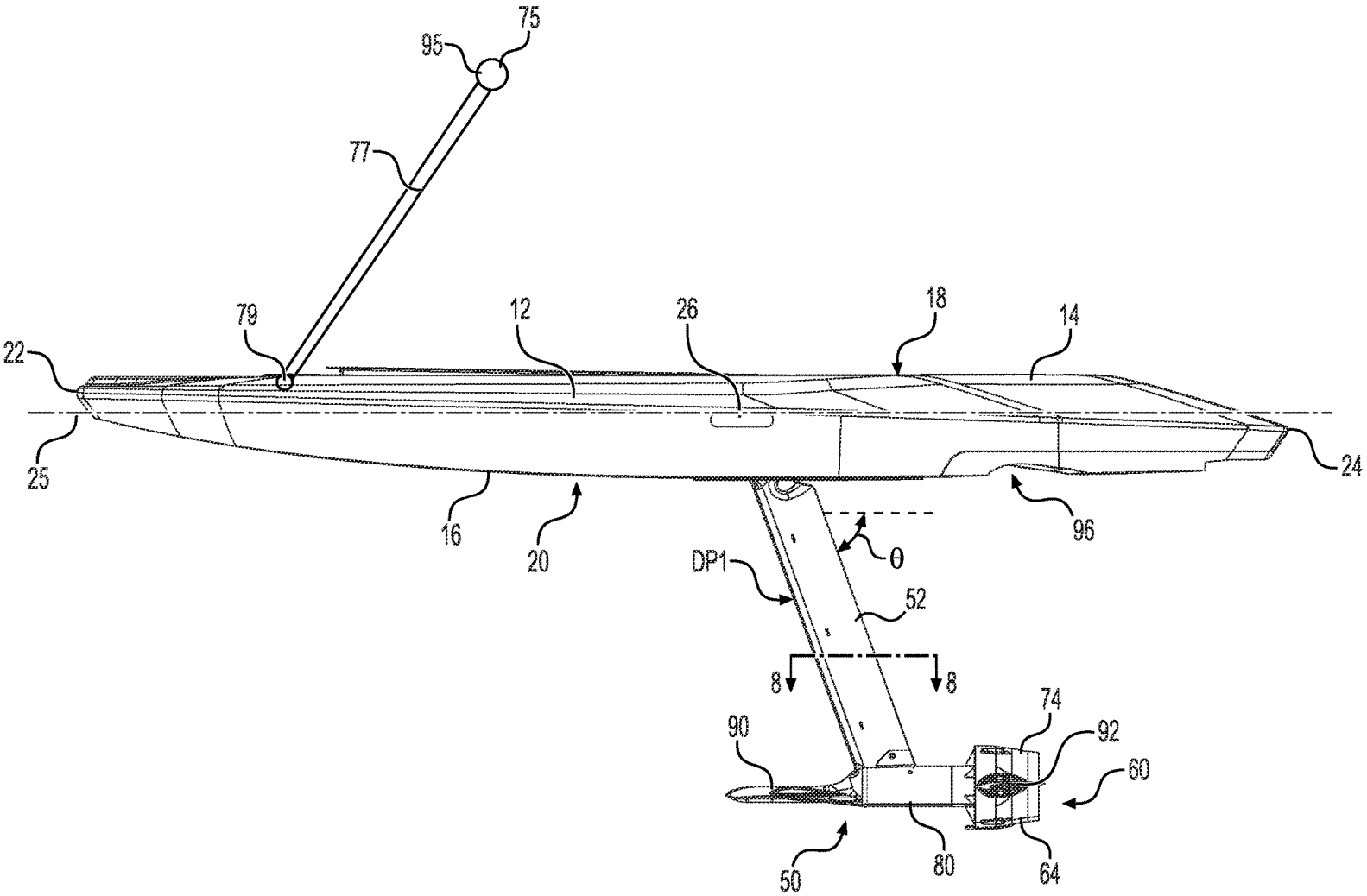
FIG. 5 is a left side elevation view of the watercraft of FIG. 1, shown with a handlebar thereof.
Figure 7:
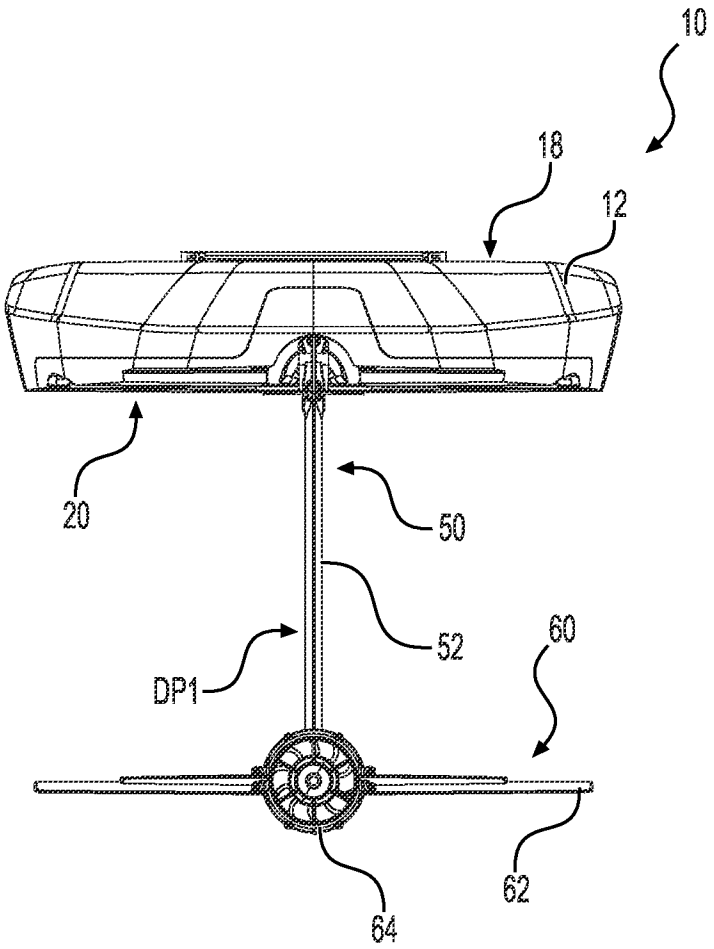
FIG. 7 is a rear elevation view of the watercraft of FIG. 1.
Figure 6:
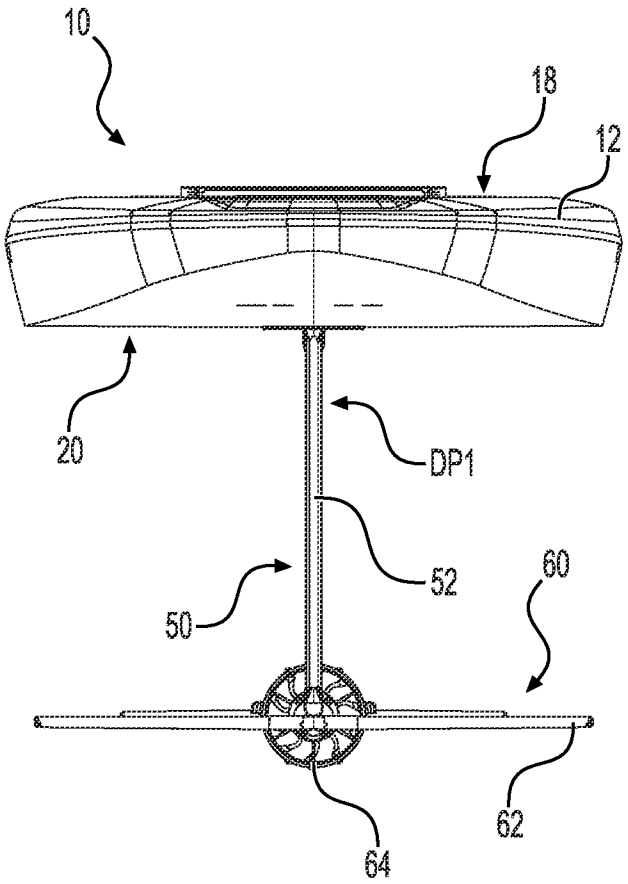
FIG. 6 is a front elevation view of the watercraft of FIG. 1.
Figure 30:
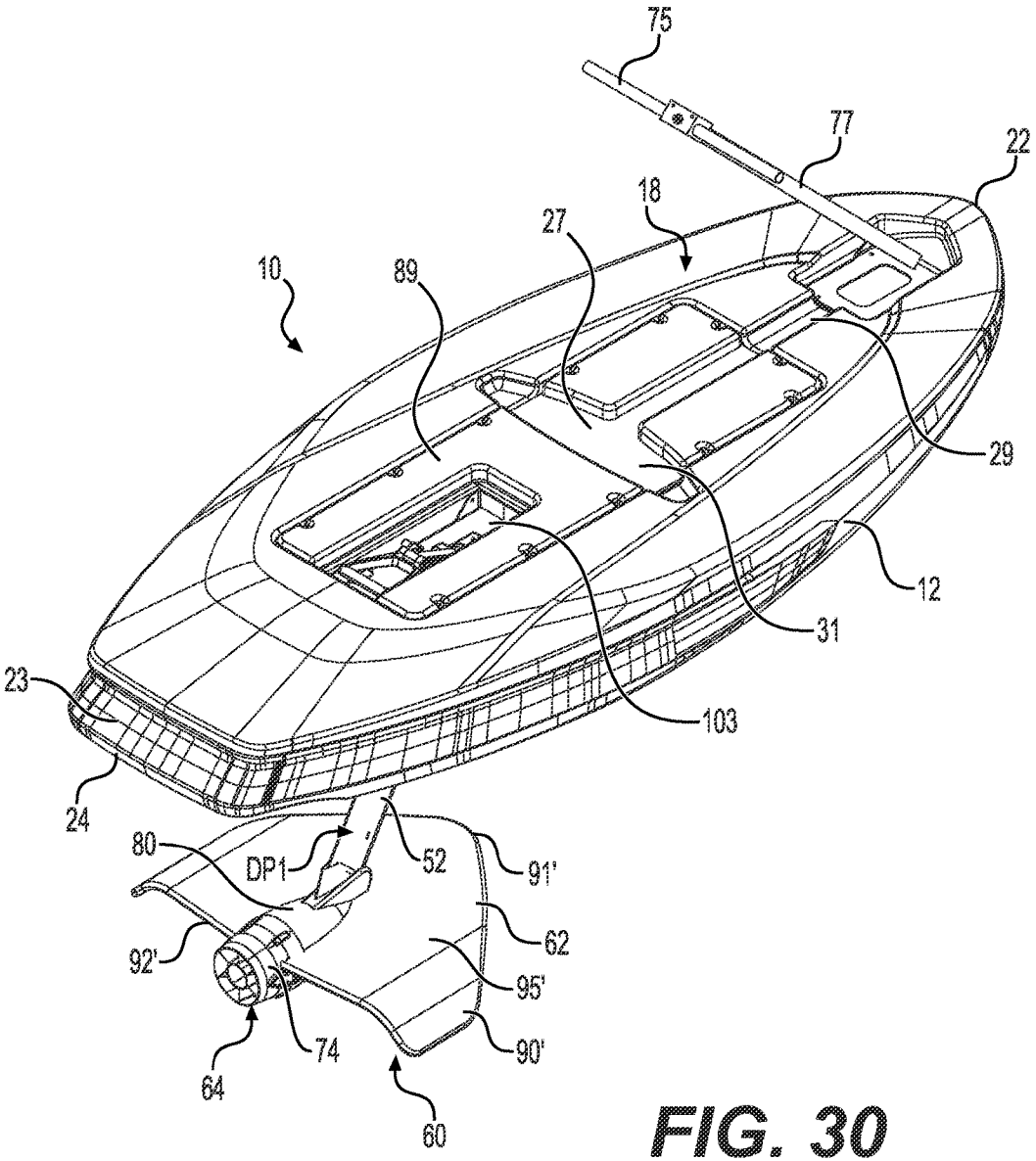
FIG. 30 is a perspective view, taken from a top, rear, right side, of a watercraft in accordance with an alternative embodiment in which a hydrofoil of the lift-propulsion assembly includes a single foil, shown with the mast in a fully deployed position.
Figure 31:
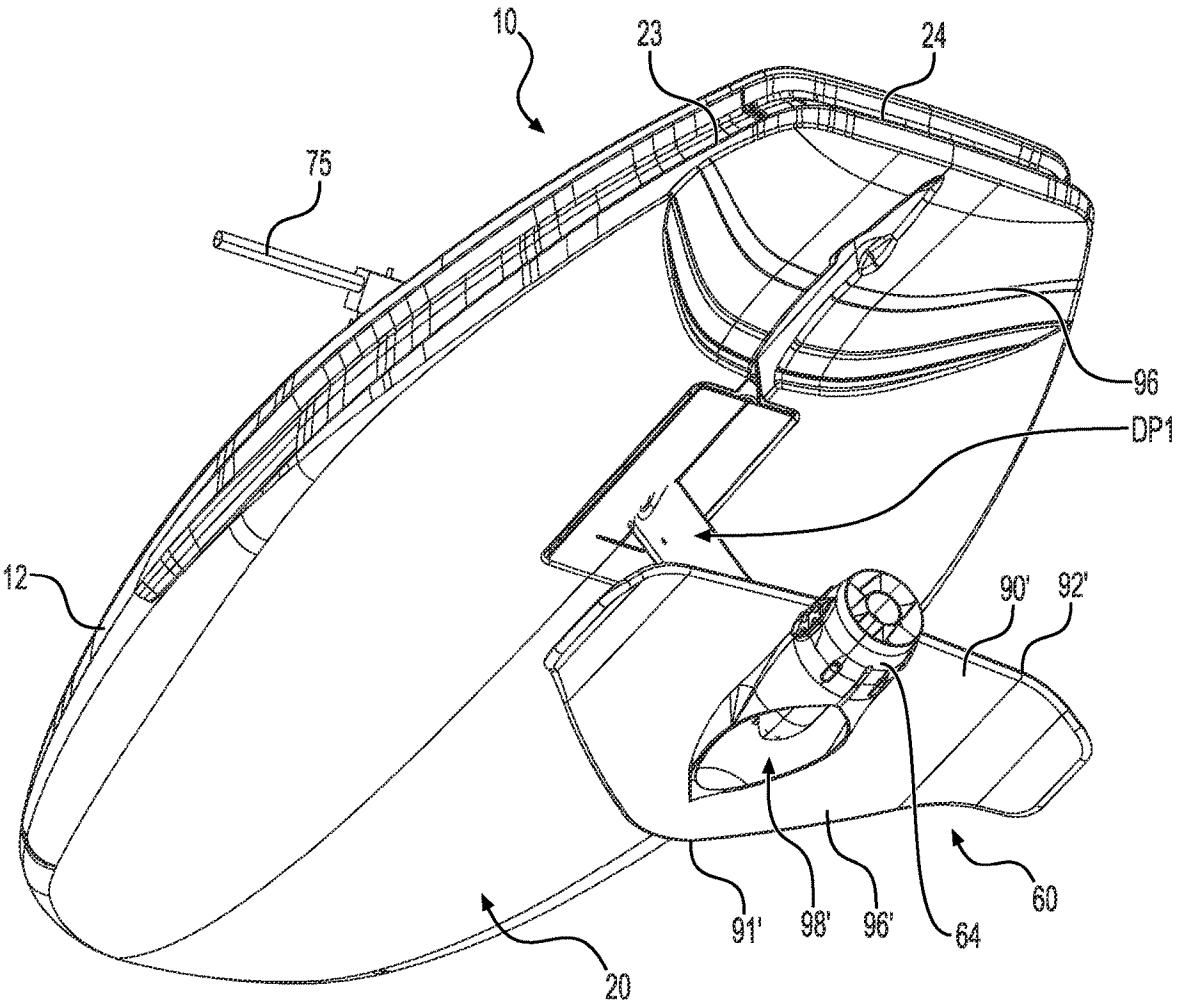
FIG. 31 is a perspective view, taken from a bottom, rear, left side, of the watercraft of FIG. 30.

As shown in FIGS. 1 to 7, the watercraft 10 has a buoyant body 12 having upper and lower surfaces 14, 16 on respective upper and lower sides 18, 20 of the buoyant body 12. In use, the operator of the watercraft 10 is positioned on the upper surface 14 (e.g., standing, kneeling, sitting, lying down) to ride the watercraft 10, whereas the lower surface 16 is configured to engage the surface of the water when the watercraft 10 is underway (and the retractable lift-propulsion system 50 is in a retracted state as will be described further below). The buoyant body 12 has a front end 22 and a rear end 24 defining a length of the buoyant body 12 therebetween. As shown in FIG. 4, a longitudinal center axis 25 of the watercraft 10 extends longitudinally between the front end 22 and the rear end 24 and bisects a width of the buoyant body 12. As shown in FIGS. 1, 2 and 5, the buoyant body 12 defines a plurality of handholds 26 at various locations to allow the operator to hold onto the watercraft 10 such as for reboarding the watercraft 10 or hold the watercraft 10 during transport. The handholds 26 may be positioned at different locations of the buoyant body 12 in different embodiments. In other embodiments, the handholds 26 may be omitted. For instance, in some embodiments, as shown in FIGS. 30 and 31, the buoyant body 12 defines a peripheral recess 23 at the rear end 24 and at the lateral sides of the buoyant body 12 to facilitate grabbing of the buoyant body 12 by the operator. In the present embodiment, the buoyant body 12 has a length of about 2 meters and a beam of about 1 meter.

Figure 9:
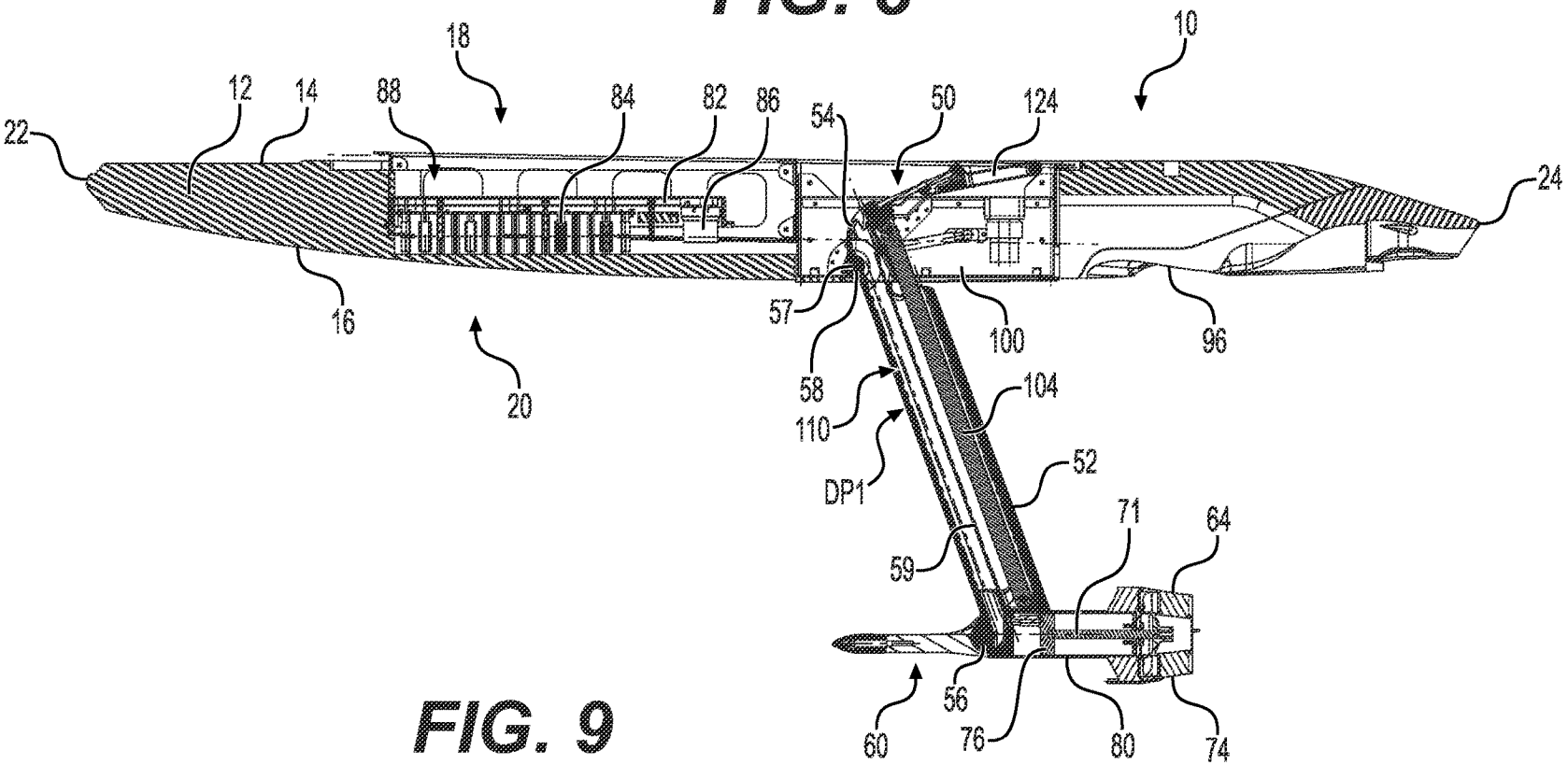
FIG. 9 is a section of the watercraft of FIG. 1 taken along a line 9-9 in FIG. 3.

As shown in FIGS. 1, 3 and 9, the buoyant body 12 also defines a chamber 88 between the upper and lower surfaces 14, 16 of the buoyant body 12. As will be described in more detail below, the chamber 88 accommodates various components of the retractable lift-propulsion system 50 therein. A removable access panel 89, shown in FIG. 3, is provided to selectively close off part of the chamber 88 from the upper side 18 of the buoyant body 12. The removable access panel 89 is generally rectangular and defines a rectangular recess 103 located at a rear end of the removable access panel 89. The removable access panel 89 can be secured in place on the buoyant body 12 in any suitable way. For instance, in this embodiment, the removable access panel 89 is fastened, via mechanical fasteners (e.g., bolts) to the buoyant body 12.

With reference to FIGS. 2 and 4, a flexible panel 97 is connected to the buoyant body 12 on the lower side 20 thereof in order to accommodate the retractable lift-propulsion system as will be explained in more detail below. The flexible panel 97 defines a slit 98 extending generally longitudinally. The flexible panel 97 may be made of any suitable flexible material. For instance, in this embodiment, the flexible panel 97 is made of rubber, an elastomer or other flexible and resilient material.

Moreover, in this embodiment, the lower surface 16 of the buoyant body 12 defines a recess 96 that is shaped to accommodate part of the retractable lift-propulsion system 50 as will be described in more detail below.

In this embodiment, the buoyant body 12 is a molded plastic buoyant body (i.e., it is molded into shape from a plastic material). It is contemplated that the buoyant body could be made from different materials and using a different process. For example, the buoyant body could be made from a foam core laminated with fiberglass or carbon fiber. Moreover, in the illustrated embodiments, the buoyant body 12 has a generally elliptical shape. It is to be understood that the configuration of the buoyant body 12 may be different in other embodiments.

Figure 16:
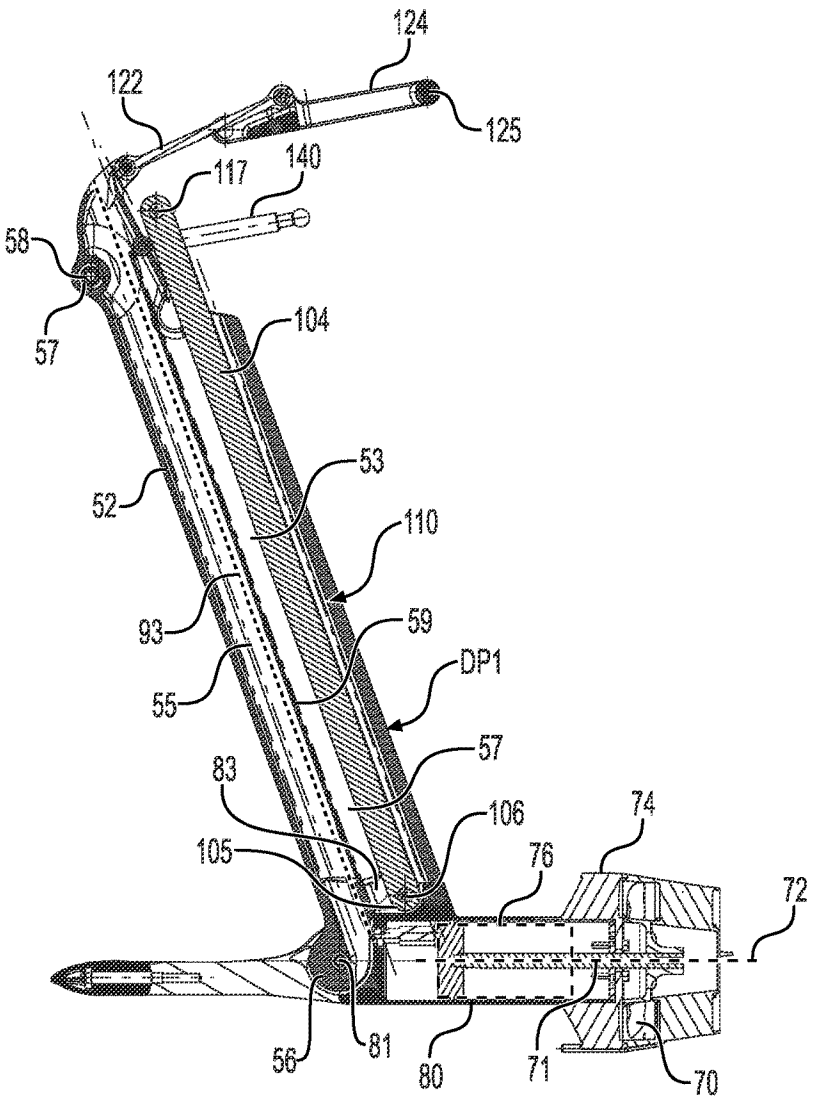
FIG. 16 is a cross-sectional view of the part of the retractable lift-propulsion system of FIG. 13 taken along line 16-16 in FIG. 14.
Figure 17:
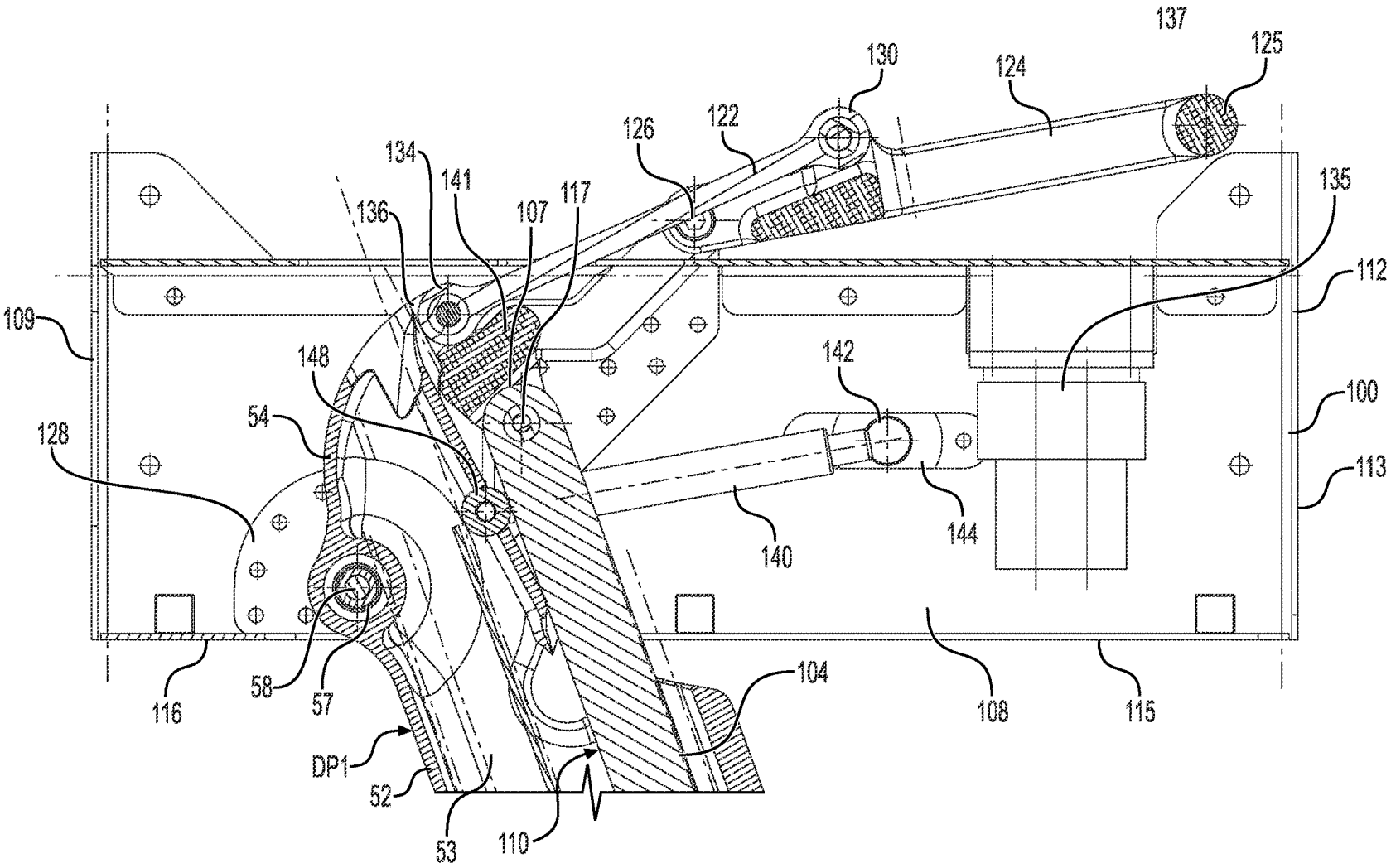
FIG. 17 is a cross-sectional view of the part of the retractable lift-propulsion system of FIG. 11 taken along line 17-17 in FIG. 11.

With particular reference to FIGS. 2, 5 to 7 and 9, the retractable lift-propulsion system 50 includes a mast 52 and a lift-propulsion assembly 60 connected thereto. The mast 52 connects the lift-propulsion assembly 60 to the buoyant body 12. The mast 52 has a proximal end 54 and a distal end 56 opposite one another. In this embodiment, the proximal end 54 of the mast 52 is pivotally connected to the buoyant body 12 of the watercraft 10. In particular, as shown in FIGS. 16 and 17, the mast 52 is pivotable about a pivot 57 defining a pivot axis 58 extending transversely through the proximal end 54 of the mast 52. The mast 52 is pivotable about the pivot axis 58 between a retracted position RP (FIGS. 20 to 25), an intermediate deployed position DP2 (FIG. 19) and a fully deployed position DP1 (FIGS. 1 to 7, 9). As will be described in more detail below, when the watercraft 10 is underway and the mast 52 is in the retracted position RP, the lift-propulsion assembly 60 does not provide any significant lift to the watercraft 10 but can still provide thrust to the watercraft 10. When the watercraft 10 is underway and the mast 52 is in either of the deployed positions DP1, DP2, the lift-propulsion assembly 60 provides lift to the watercraft 10 and can also provide thrust to the watercraft 10.

Figure 19:
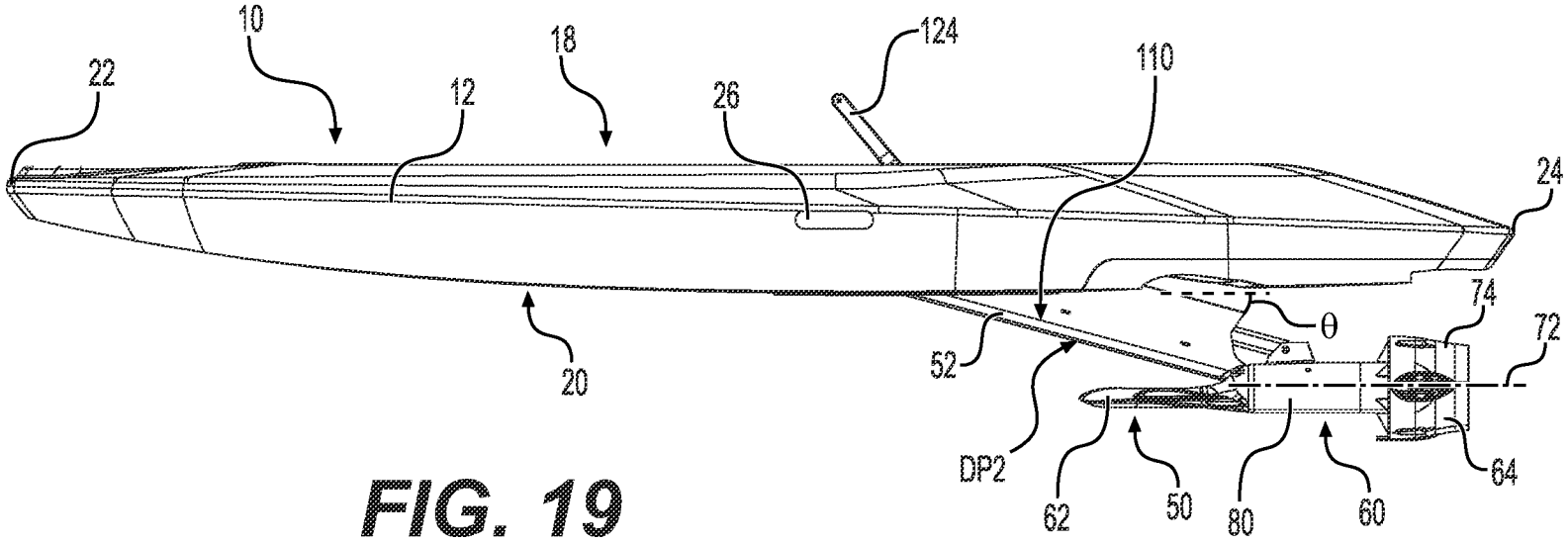
FIG. 19 is a left side elevation view of the watercraft of FIG. 11, shown with the mast in an intermediate deployed position.
Figure 20:
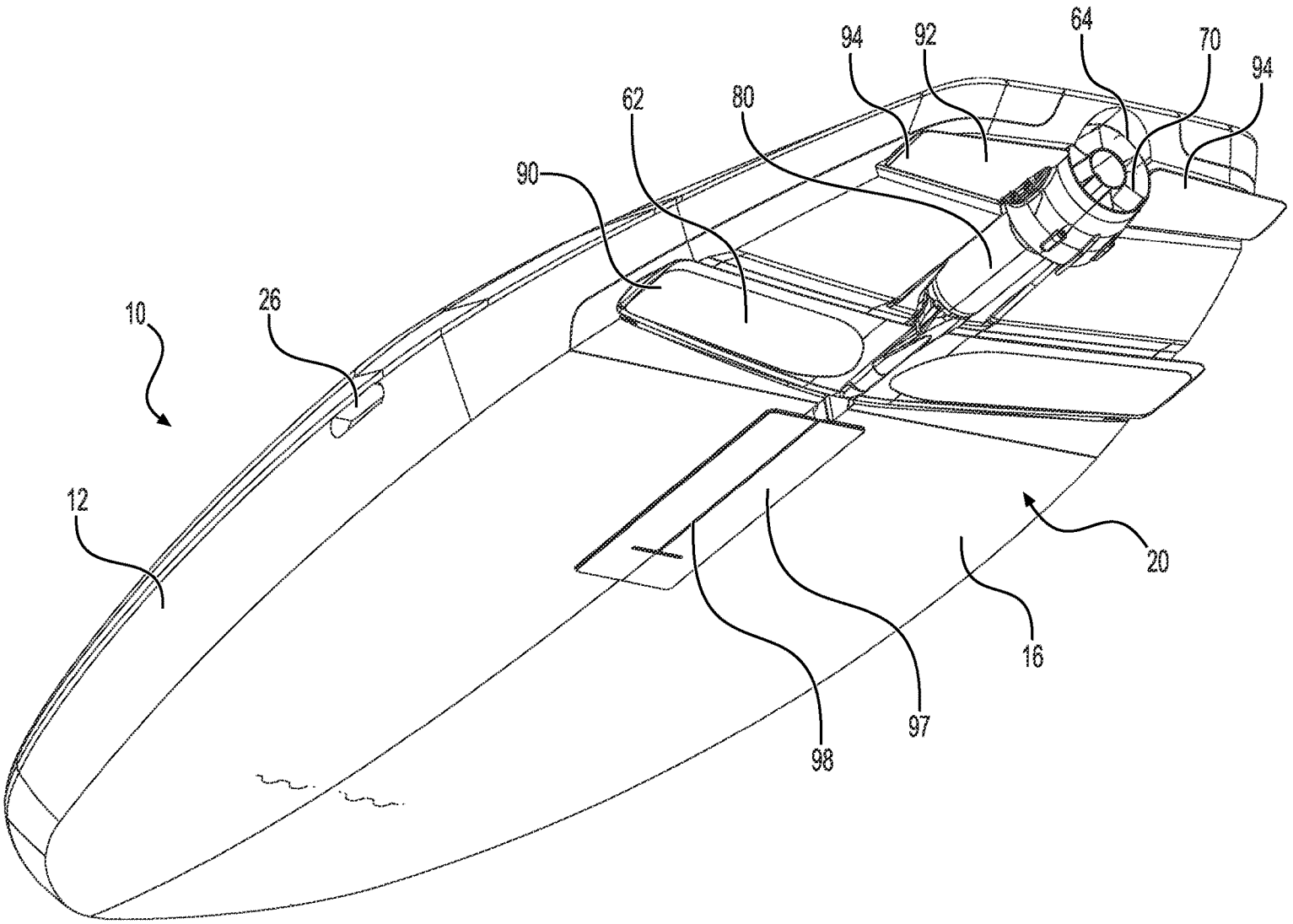
FIG. 20 is a perspective view, taken from a bottom, rear, left side, of the watercraft of FIG. 1, shown with the mast in a retracted position.
Figure 21:
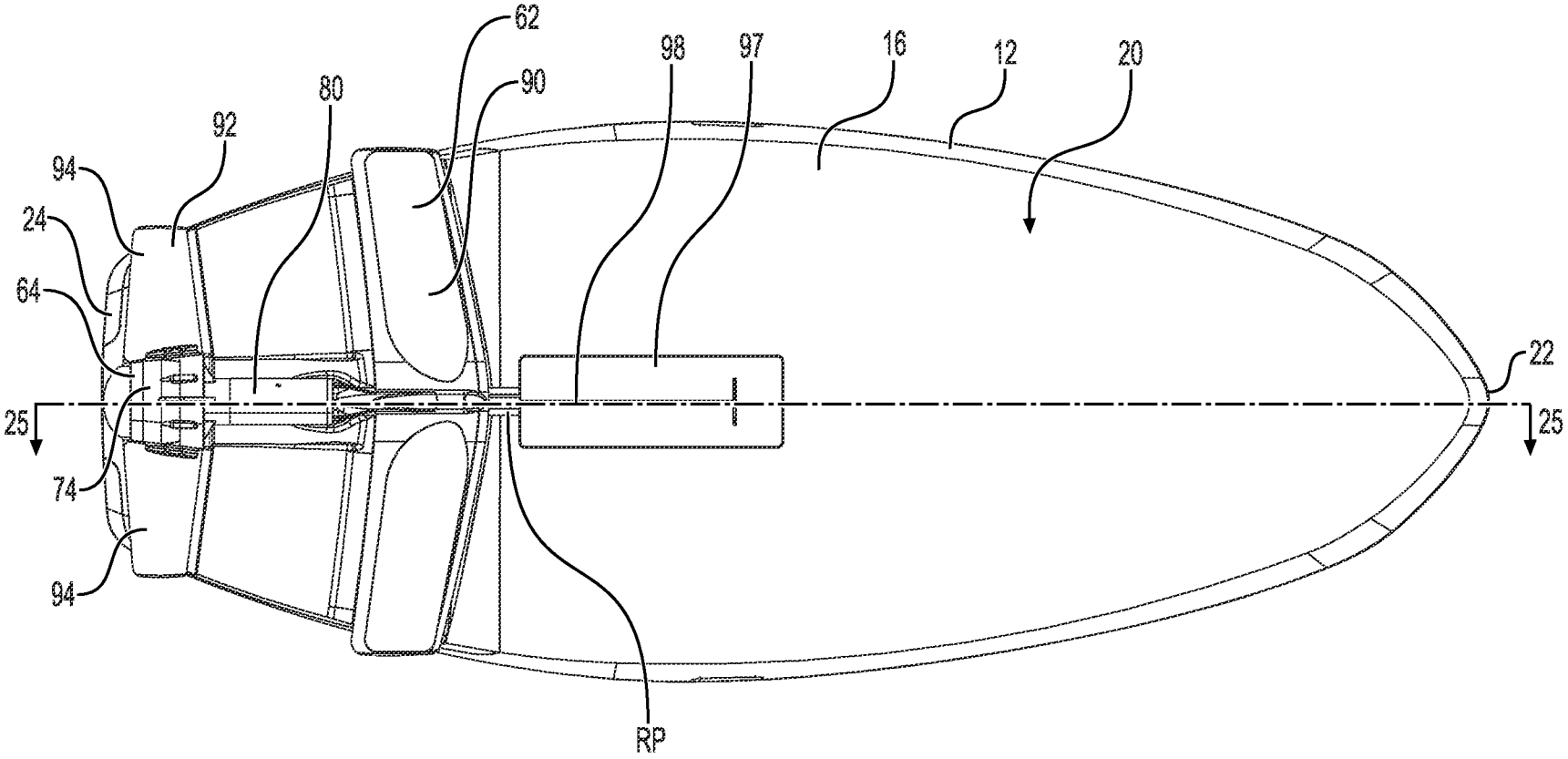
FIG. 21 is a bottom plan view of the watercraft of FIG. 20.
Figure 22:
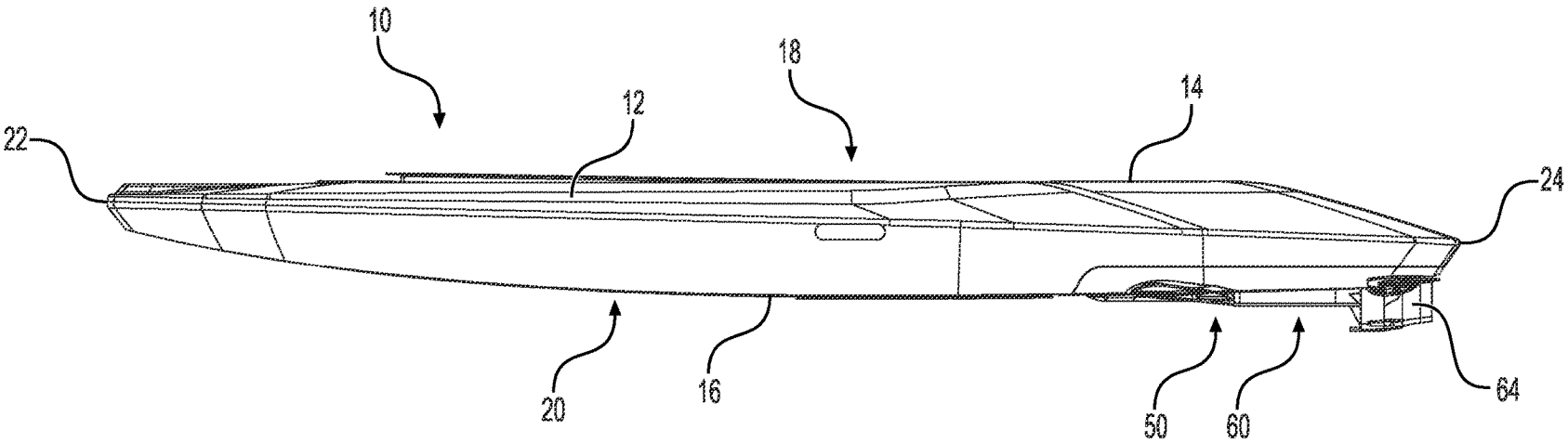
FIG. 22 is a left side elevation view of the watercraft of FIG. 20.
Figure 23:
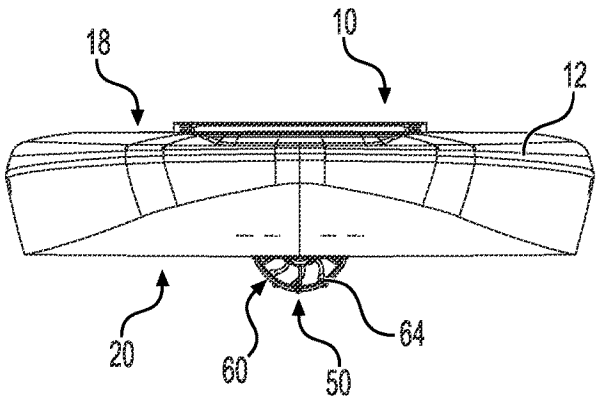
FIG. 23 is a front elevation view of the watercraft of FIG. 20.
Figure 24:
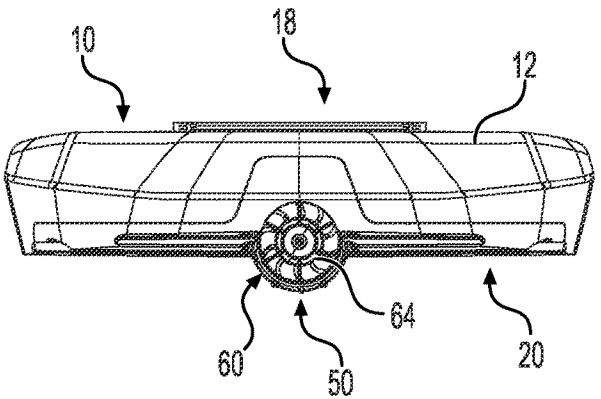
FIG. 24 is a rear elevation view of the watercraft of FIG. 20.
Figure 25:
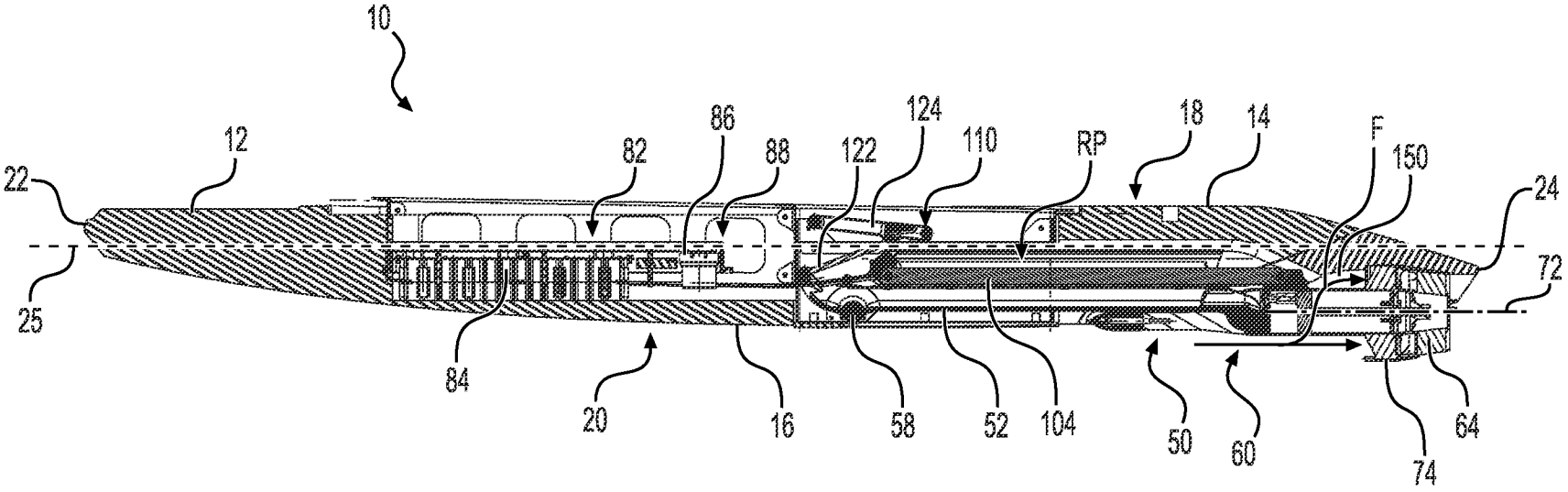
FIG. 25 is a cross-sectional view of the watercraft of FIG. 20 taken along line 25-25 in FIG. 21.

As shown in FIG. 25, in the retracted position RP, the mast 52 extends generally parallel to the longitudinal center axis 25 of the watercraft 10. Moreover, in the retracted position RP, a majority of the mast 52 is disposed between the upper and lower surfaces 14, 16 of the buoyant body 12. As shown in FIGS. 5 and 19, in the deployed positions DP1, DP2, the mast 52 extends from the lower side 20 of the buoyant body 12. In particular, in the deployed positions DP1, DP2, the mast 52 extends through the slit 98 of the flexible panel 97. As such, a distance between the distal end 56 of the mast 52 and the lower surface 16 of the buoyant body 12 is greater in the deployed positions DP1, DP2 than in the retracted position RP. The fully deployed position DP1 corresponds to a lowest position of the distal end 56 of the mast 52. As such, the distance between the distal end 56 of the mast 52 and the lower surface 16 of the buoyant body 12 is greater in the fully deployed positions DP1 than in the intermediate deployed position DP2.

With reference to FIGS. 5 and 19, in the deployed positions DP1, DP2 of the mast 52, the mast 52 is disposed at an angle θ relative to a horizontal axis parallel to the longitudinal center axis 25. The angle θ measures less than 90° (i.e., is an acute angle) in both the deployed positions DP1, DP2. This places the lift-propulsion assembly 60 farther rearward than if the angle θ were square as is often the case in conventional boards equipped with lift-propulsion systems. Having the lift-propulsion system 60 farther rearward can aid in handling of the watercraft 10. With more particularity, in the fully deployed position DP1 of the mast 52, the angle θ may measure between 50° and 70° inclusively. In this embodiment, in the fully deployed position DP1 of the mast 52, the angle θ measures approximately 70° (±5°). In the intermediate deployed position DP2 of the mast 52, the angle θ may measure between 10° and inclusively. As will be appreciated, due to the mast 52 being positionable in more than a single deployed position, namely the fully deployed position DP1 and the intermediate deployed position DP2, the operator of the watercraft 10 has greater control over the amount of lift that is provided by the lift-propulsion system 60 (i.e., how high the buoyant body 12 rises above the water).

It is to be understood that the mast 52 acquires different transitory positions as it moves between the retracted position RP, the intermediate deployed position DP2, and the fully deployed position DP1. In some embodiments, the mast 52 may also be able to stay in any or all of these different positions. The mast 52 may thus have more intermediate deployed positions.

It is contemplated that, in other embodiments, the retracted and deployed positions RP, DP1, DP2 of the mast 52 could be different while still ensuring that the distance between distal end 56 of the mast 52 and the lower surface 16 of the buoyant body 12 is greater in the deployed positions DP1, DP2 than in the retracted position RP. For instance, in some embodiments, the deployed positions DP1, DP2 of the mast 52 could be arrived at from the retracted position RP by a vertical translation of the mast 52, with part of the mast 52 extending through and/or being received in the buoyant body 12 in the intermediate deployed position DP2 and the retracted position RP.

Figure 8:
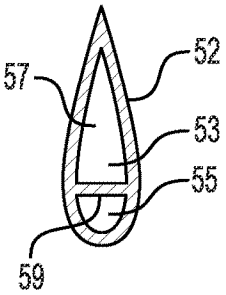
FIG. 8 is a cross-sectional view of the mast of the watercraft of FIG. 1 taken along line 8-8 in FIG. 5.

As shown in FIG. 8, in this embodiment, the mast 52 has a cross-sectional profile that is lacrimiform. Notably, in the deployed positions DP1, DP2 of the mast 52, a rounded end of the cross-sectional profile of the mast 52 faces the front end 22 of the buoyant body 12 while an opposite pointed end of the mast 52 faces the rear end 24 of the buoyant body 12. As can be seen, the mast 52 is hollow, namely defining an inner space 53. The inner space 53 is divided into two channels 55, 57 by a dividing wall 59.

It is contemplated that the mast 52 could be configured differently in other embodiments.

The movement of the mast 52 between its various positions RP, DP1, DP2 is guided and actuated by a mast assembly 110 which will be described in greater detail below.

With reference to FIGS. 11 to 16, the lift-propulsion assembly 60 includes a hydrofoil 62 and a propulsion unit 64. The hydrofoil 62 is configured to provide lift to the watercraft 10 while the propulsion unit 64 is configured to provide thrust to the watercraft 10. The lift-propulsion assembly 60 is connected to the distal end 56 of the mast 52 such that, in the deployed positions DP1, DP2 of the mast 52, the lift-propulsion assembly 60 is distanced from the buoyant body 12 and, in the retracted position RP of the mast 52, the lift-propulsion assembly 60 is proximate the buoyant body 12. The proximity of the lift-propulsion assembly 60 to the buoyant body 12 in the retracted position RP of the mast 52 is helpful to make the watercraft 10 compact and easy to transport and, as will be discussed further below, able to operate in shallower waters. Furthermore, as can be seen in FIGS. 9 and 25, the lift-propulsion assembly 60 is disposed further rearward in the retracted position RP of the mast 52 than in the deployed positions DP1, DP2 of the mast 52.

The position of the lift-propulsion assembly 60 relative to the mast 52 is such that the hydrofoil 62 provides lift to the watercraft 10 in the deployed positions DP1, DP2 of the mast 52 but not significantly in the retracted position RP, thereby allowing the operator to place the mast 52 in the retracted position RP when he/she does not desire to ride the watercraft 10 with lift provided by the hydrofoil 62. On the other hand, the propulsion unit 64 provides thrust to the watercraft 10 (on command from the operator) in all the positions of the mast 52, including the retracted position RP and the deployed positions DP1, DP2. Therefore, the propulsion unit 64 can be operated to propel the watercraft 10 irrespective of the position of the mast 52.

With reference to FIG. 19, in the intermediate deployed position DP2 of the mast 52, the propulsion unit 64 is further from the buoyant body 12 than in the retracted position RP which allows less turbulent flow of water to the propulsion unit 64. Moreover, in the intermediate deployed position DP2 of the mast 52, the watercraft 10 can be operated in shallower water than allowed when the mast 52 is in the fully deployed position DP1.

The propulsion unit 64 is a pump jet propulsion system which includes an impeller 70 rotatable about a rotating axis 72. In this embodiment the impeller 70 has blades that, when rotated about the rotating axis 72, transform rotational power into linear thrust by acting upon water. It is contemplated that the impeller 70 could be a rotor in other embodiments. The propulsion unit 64 also has a duct 74 surrounding the impeller 70 so as to improve the efficiency of the impeller 70.

The lift-propulsion assembly 60 has an electric motor 76 (FIG. 16) for driving the impeller 70 of the propulsion unit 64. In particular, the electric motor 76 has a driving shaft (not shown) that is operatively connected to an impeller shaft 71 that is connected to the impeller 70 to allow the electric motor 76 to rotate the impeller 70 about the rotating axis 72. As can be seen, in this embodiment, the electric motor 76 is connected to a frame 80 of the lift-propulsion assembly 60. More specifically, the electric motor 76 is enclosed within the frame 80. The frame 80 is generally tubular and extends in a longitudinal direction of the watercraft 10 (i.e., generally parallel to the center axis 25). In this embodiment, the electric motor 76 is a 6 kW motor, but other types of electric motors are contemplated.

In this embodiment, the electric motor 76 can be made to drive the impeller shaft 71 in both directions about the rotating axis 72. Therefore, the impeller 70 can provide forward or reverse thrust. Moreover, the impeller 70 can be driven in forward or reverse at the same time as the mast 52 is being moved between the different positions RP, DP1, DP2 in order to further facilitate movement of the mast 52.

An electrical assembly 82 is provided to work in conjunction with the electric motor 76. In particular, in this embodiment, the electrical assembly 82 has a battery 84 which stores energy for powering the electric motor 72 and an inverter 86 in electrical communication between the battery 84 and the electric motor 72. In this embodiment, the battery 84 has a nominal voltage of 48V and a capacity of 2.5 kWh, but batteries having other nominal voltages and power capacities are contemplated. The inverter 86 converts the direct current (DC) of the battery 84 to alternating current (AC) which powers the electric motor 76. As shown in FIG. 16, electrical wires 93 extend within the mast 52, within the channel 55 to electrically connect the electric motor 76 to the electrical assembly 82. It is contemplated that more than one battery 84 could be provided.

The electrical assembly 82 is supported by the buoyant body 12. In particular, the electrical assembly 82 is housed in the chamber 88 defined by the buoyant body 12. The part of the chamber 88 enclosing the electrical assembly 82 is accessible from the upper side 18 of the buoyant body 12, notably by removing the removable access panel 89. As can be seen in FIG. 9, the battery 84 is positioned in the chamber 88, adjacent a front end thereof.

Figure 10:
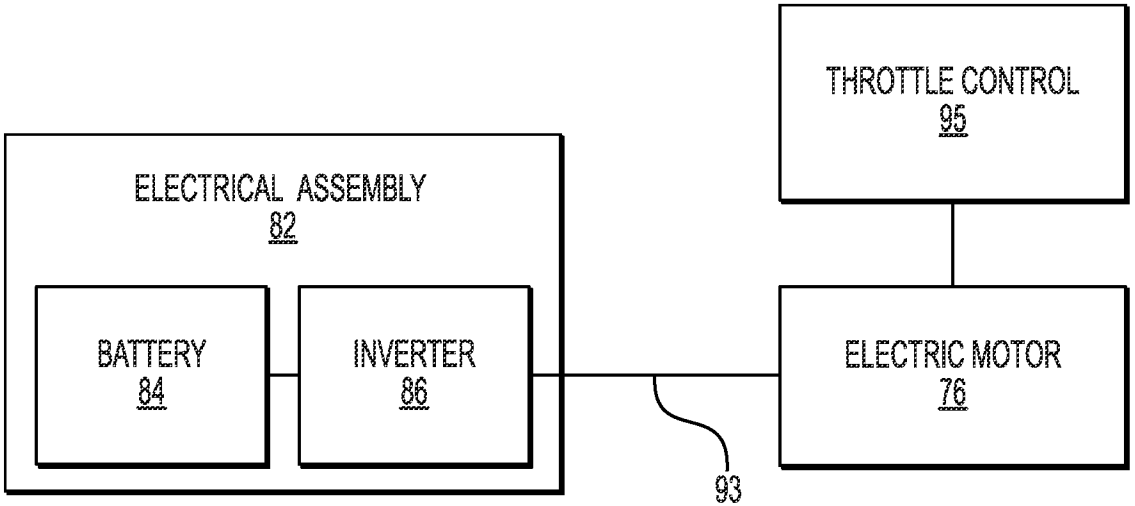
FIG. 10 is a block diagram showing an electrical assembly and an electric motor of the retractable lift-propulsion system of the watercraft of FIG. 1.

With reference to FIG. 10, the retractable lift-propulsion system 50 also has a throttle control 95 for use by the operator of the watercraft 10. Notably, the throttle control 95 is in communication with the electric motor 76 to control driving of the propulsion unit 64 by the electric motor 76. In this embodiment, as shown in FIG. 5, the throttle control 95 is disposed on a handlebar 75 that is connected to the buoyant body 12. In particular, the throttle control 95 is a lever (not shown) provided on the handlebar 75. A pole 77 connects the handlebar 75 to the buoyant body 12. In particular, the pole 77 is pivotally connected by a pivot 79 on the upper side 18 to the buoyant body 12. The pole 77 can therefore be pivoted about the pivot 79 to allow its operation at various heights so that the operator can hold onto the handlebar 75 and actuate the throttle control 75 when kneeling or standing.

Figure 33:
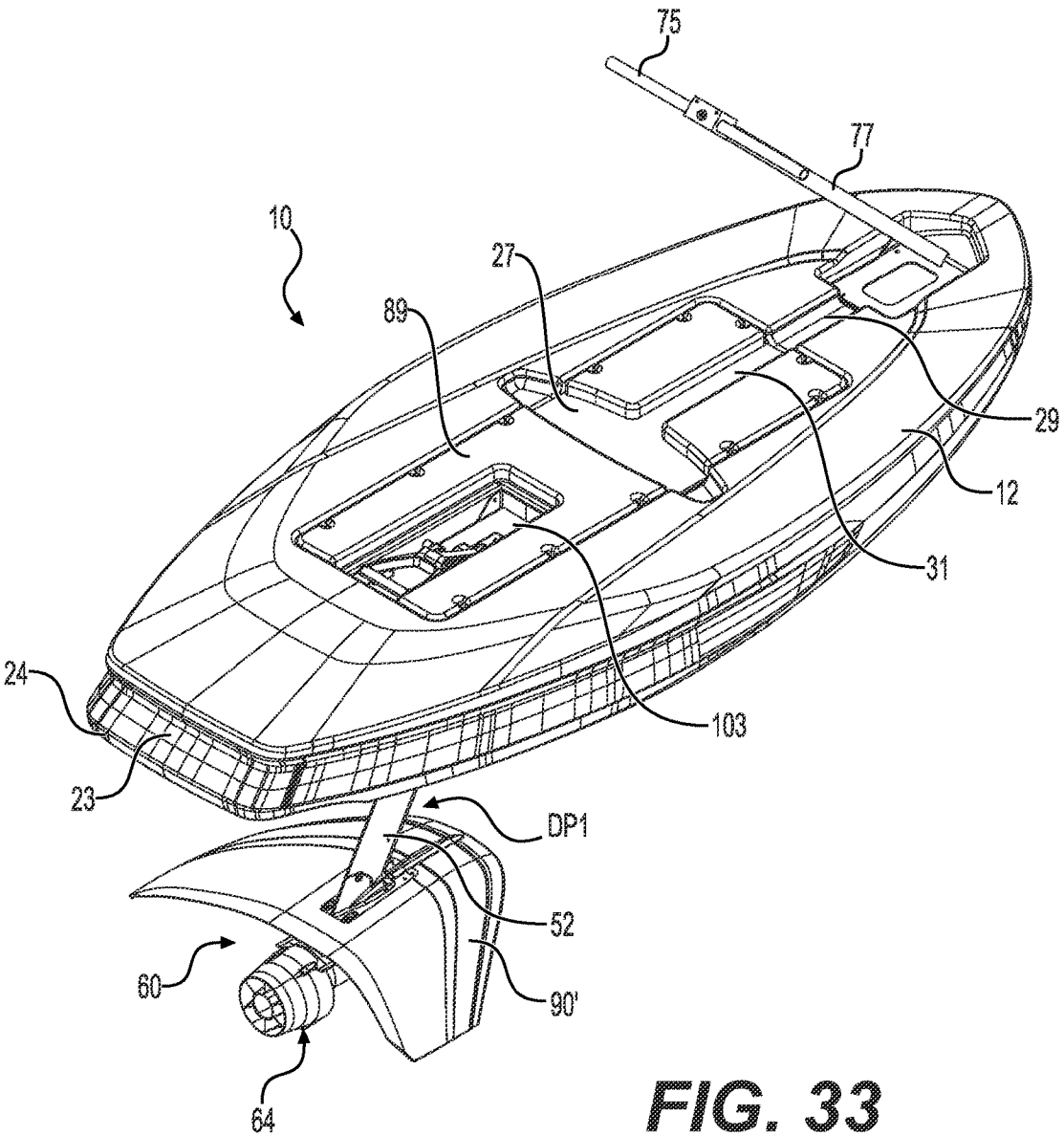
FIG. 33 is a perspective view, taken from a top, rear, right side, of a watercraft in accordance with an alternative embodiment in which a propulsion unit is disposed below the hydrofoil of the lift-propulsion assembly, with the mast shown in a fully deployed position.
Figure 34:
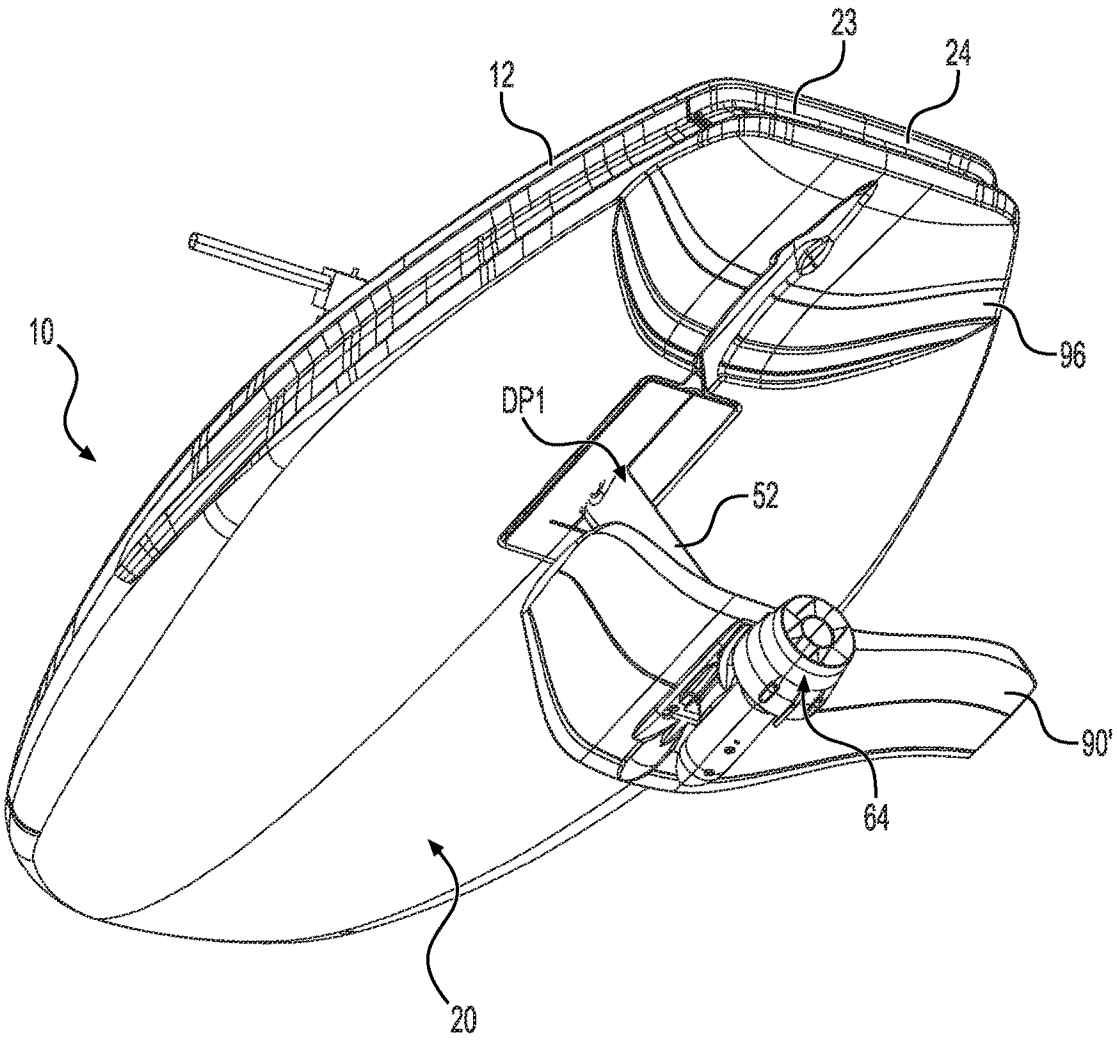
FIG. 34 is a perspective view, taken from a bottom, rear, left side, of the watercraft of FIG. 33.
Figure 35:
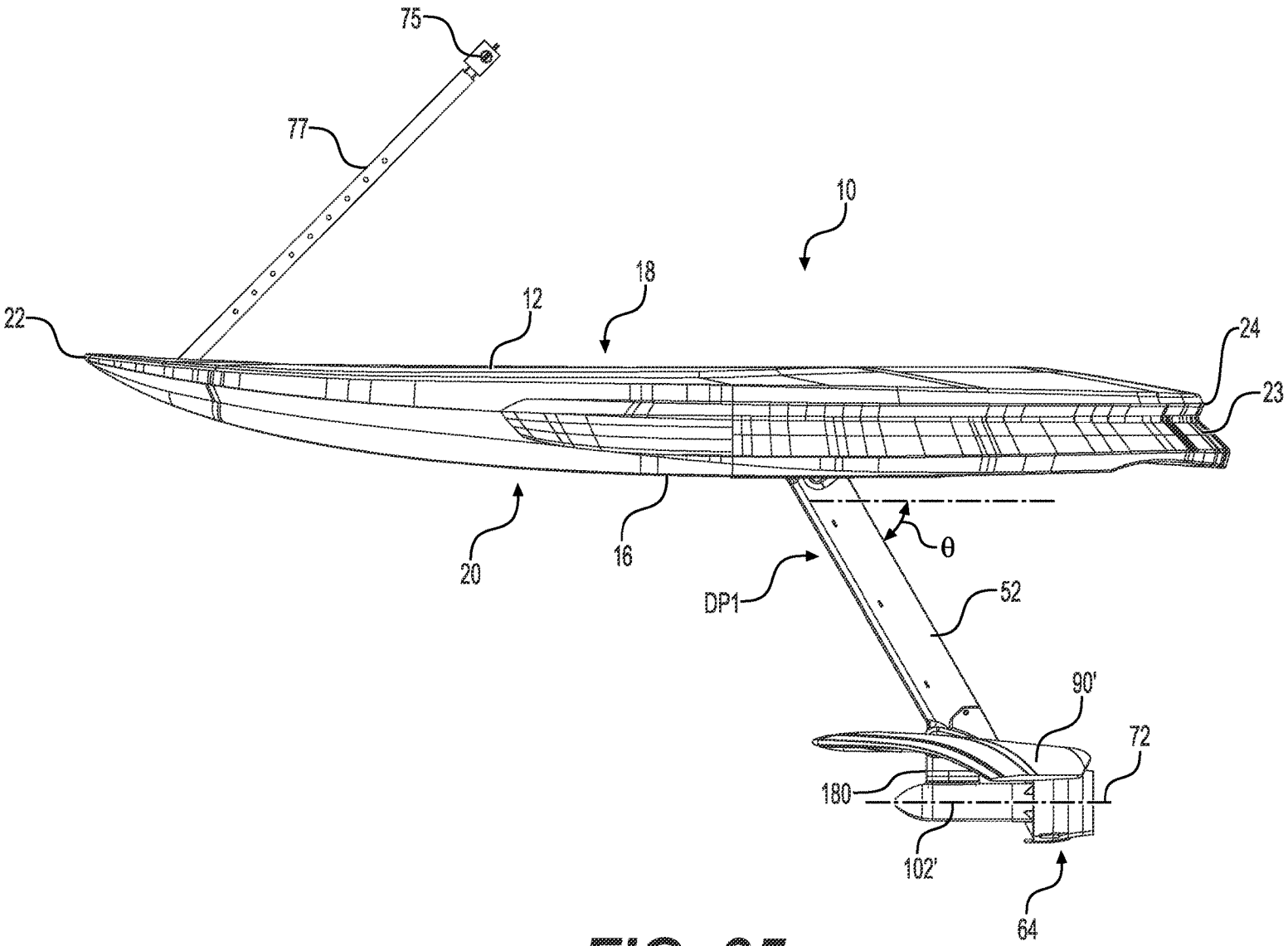
FIG. 35 is a left side elevation view of the watercraft of FIG. 33.
Figure 36:
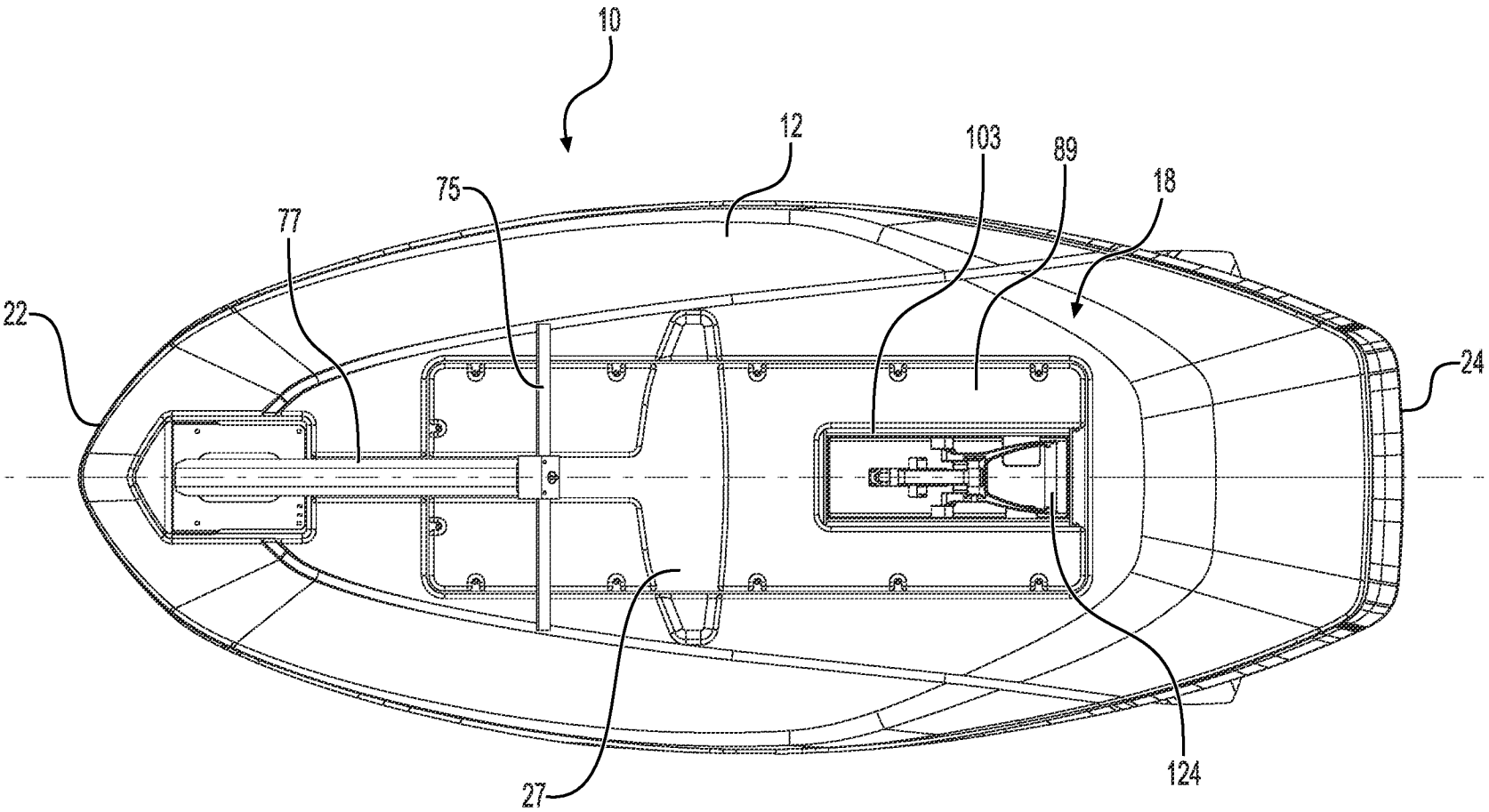
FIG. 36 is a top plan view of the watercraft of FIG. 33.

It is contemplated that the pole 77 could be removable from the buoyant body 12 and the throttle control 95 could be removed from the handlebar 75 to allow its handheld operation. It is also contemplated that, in other embodiments, the throttle control 95 could be comprised by a handheld device (e.g., a remote control) that is in wireless communication with the electric motor 76 for control thereof. Moreover, as shown with reference to FIGS. 33 and 36 (which show an alternative embodiment described in more detail below), the buoyant body 12 and the removable access panel 89 may define a recess 27 together for receiving the pole 77 and the handlebar 75 when they are stowed away (e.g., if the operator decides to use the throttle control 95 as a handheld device detached from the handlebar 75). The recess 27 is thus complementarily shaped to the pole 77 and the handlebar 75. Each of the buoyant body 12 and the removable access panel 89 defines a respective portion 29, 31 of the recess 27.

Figure 11:
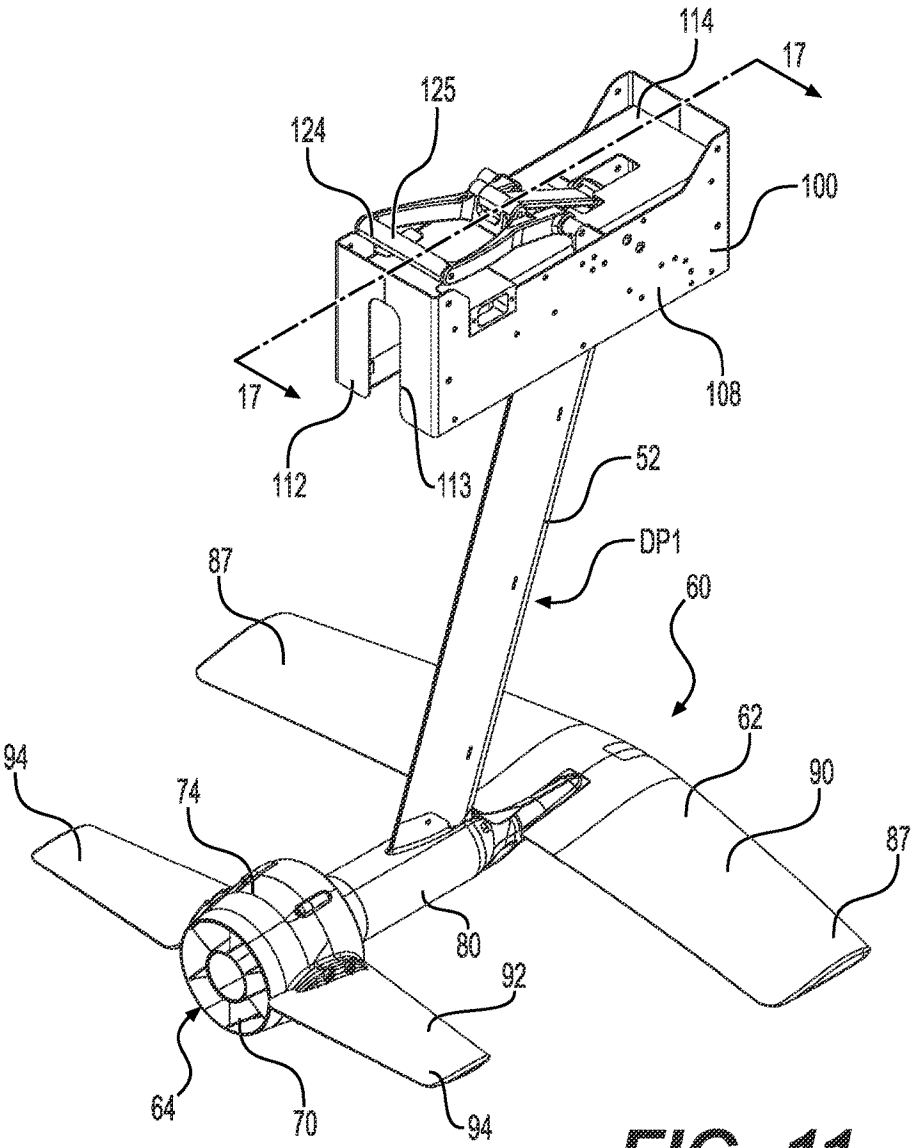
FIG. 11 is a perspective view, taken from a top, rear, right side, of part of the retractable lift-propulsion system of the watercraft of FIG. 1, including the mast, a lift-propulsion assembly and an inner housing.
Figure 12:
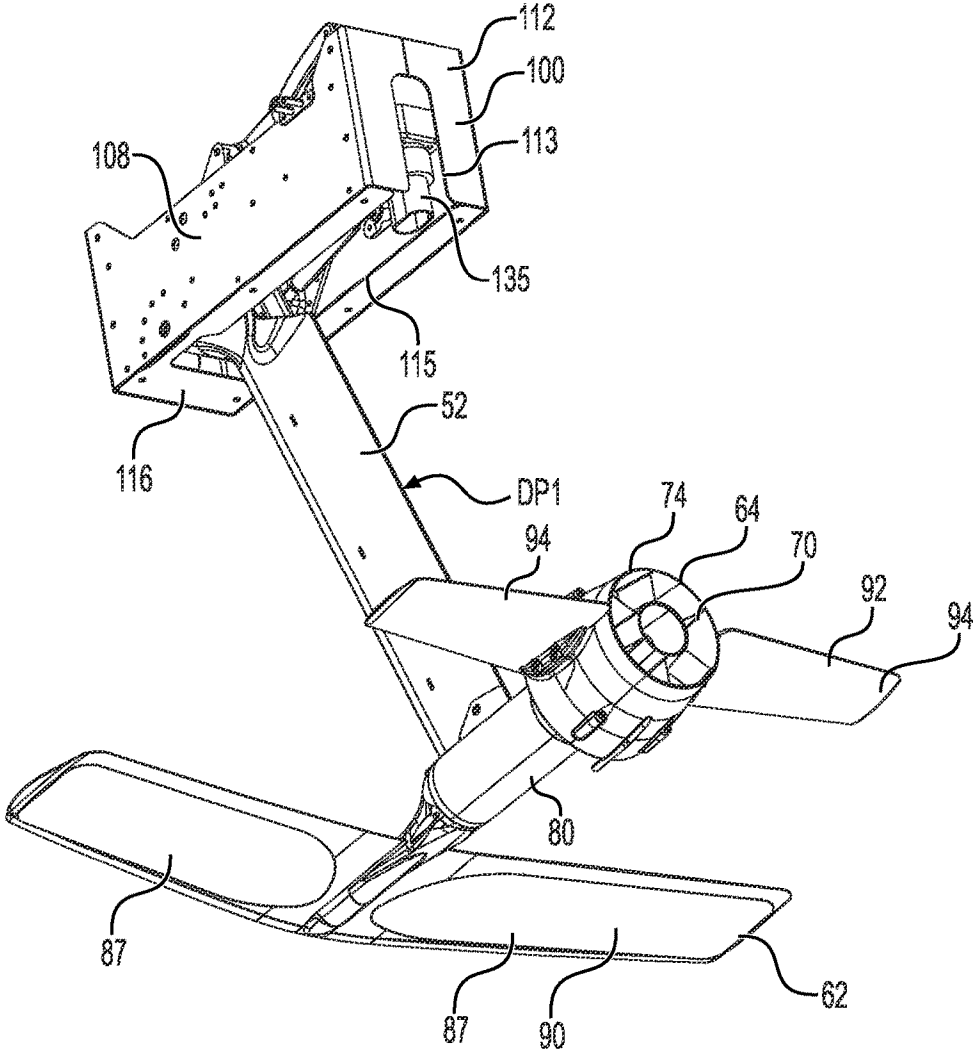
FIG. 12 is a perspective view, taken from a bottom, rear, left side, of the part of the retractable lift-propulsion system of FIG. 11.

With reference to FIGS. 11 and 12, in this embodiment, the hydrofoil 62 has a front foil 90 and a rear foil 92 disposed rearward of the front foil 70. When the mast 52 is in either of the deployed positions DP1, DP2 and the watercraft 10 is underway moving forwardly above a certain speed, the hydrofoil 62 lifts the buoyant body 12 completely out of the water thereby decreasing drag and allowing the watercraft 10 to attain greater speeds. The front foil 90 has a greater lateral span than the rear foil 92. The front foil 90 has two wings 87 extending laterally and being connected to one another at a center therebetween. The rear foil 92 has two wings 94, each extending laterally from a respective lateral side of the duct 74 of the propulsion unit 64 in opposite directions. The hydrofoil 62 and the propulsion unit 64 are connected to the frame 80 of the lift-propulsion assembly 60. In particular, the front foil 90 is connected to a front end of the frame 80 while the duct 74 of the propulsion unit 64 is connected to a rear end of the frame 80.

It is contemplated that the hydrofoil 62 could be configured differently in other embodiments. For instance, in an alternative embodiment shown in FIGS. 30 to 32, the hydrofoil 62 includes a single foil 90' rather than the two foils 90, 92. The foil 90' is centered, in the lateral direction, relative to the frame 80 and the propulsion unit 64. Moreover, as can be seen, the foil 90' has a front end 91' and a rear end 92' distanced from one another such that a length of the foil 90' is significant compared to either of the foils 90, 92 described above. For instance, the front end 91' is disposed frontwards of the frame 80 and the rear end 92' is aligned with the duct 74 of the propulsion unit 64. In particular, at its rear end 92', the foil 90' extends laterally outwardly from the duct 74 from both lateral sides thereof.

Figure 32:
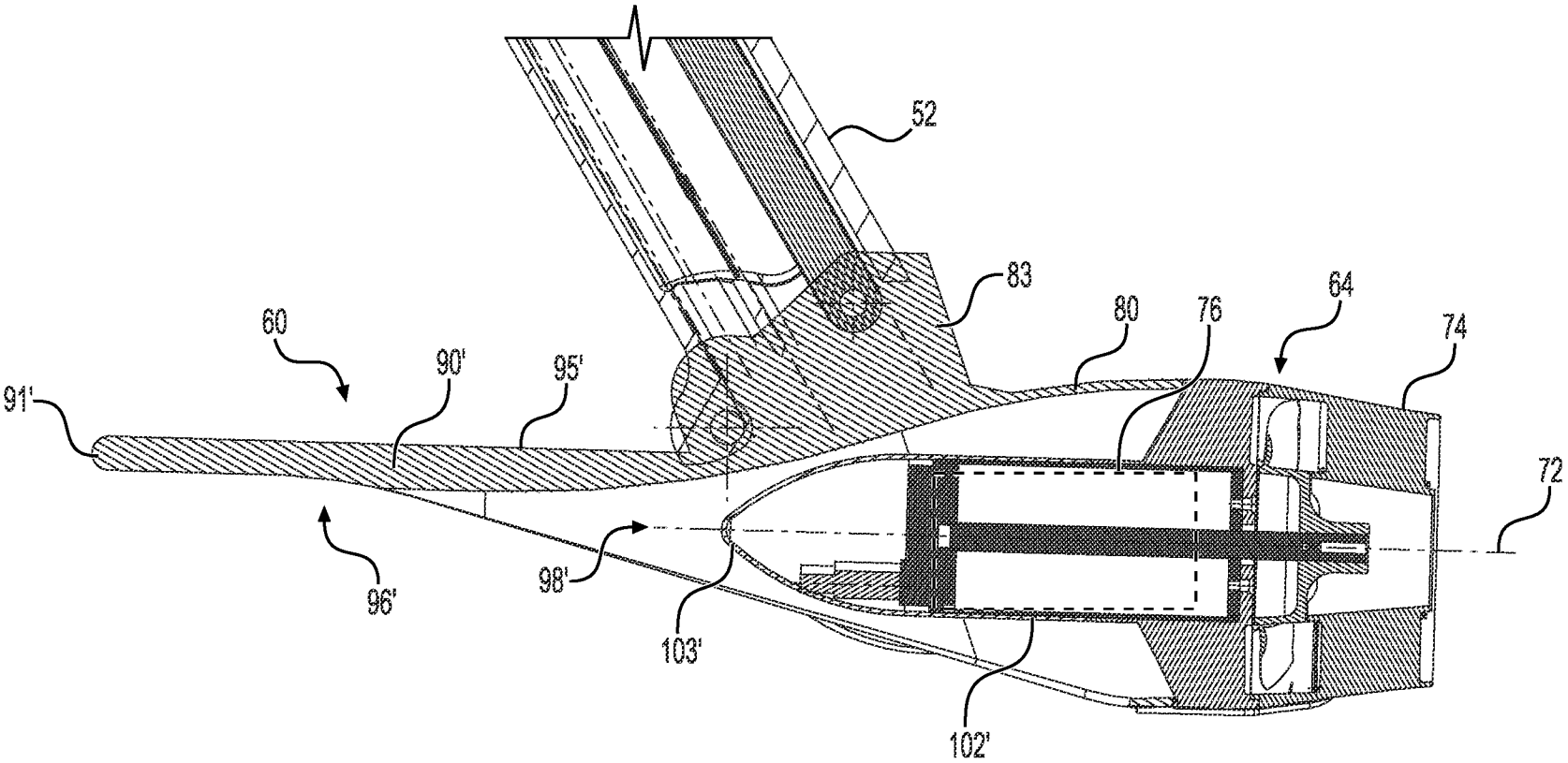
FIG. 32 is a cross-sectional view of the lift-propulsion assembly of the watercraft of FIG. 30.

The provision of the single foil 90' rather than the two foils 90, 92 may be useful to reduce the amount of air bubbles (generated by turbulent flow) that reach the propulsion unit 64 which might otherwise reduce its thrust. For instance, as can be seen in FIGS. 30 and 32, in this embodiment, an upper surface 95' of the foil 90' is continuous from the front end 91' to the rear end 92' to prevent air bubbles travelling down the mast 52 from entering the duct 74 of the propulsion unit 64. A boss 83 of the frame 80 (FIG. 32), to which the mast 52 is pivotally connected, extends above the upper surface 95' of the foil 90'. As can be seen in FIGS. 31 and 32, the hydrofoil 62 defines a tunnel 98' on a lower side 96' of the foil 90' which guides water towards the impeller 70. A motor housing 102' is disposed inside the tunnel 98' and contains the electric motor 76 therein. The motor housing 102' defines a nose cone 103' at its front end and is connected to the duct 74 at its rear end. Furthermore, in this embodiment, the frame 80 and the foil 90' are made integrally.

In this alternative embodiment in which the single foil 90' is provided, the angle θ in the fully deployed position DP1 is lower than when the front and rear foils 90, 92 are provided. For instance, in the fully deployed position DP1 of the mast 52, the angle θ measures approximately 60° (±5°).

Returning to FIG. 2, the recess 96 defined by the lower surface 16 of the buoyant body 12 is designed to accommodate the lift-propulsion assembly 60 in the retracted position RP to allow the lift-propulsion assembly 60 to be as high as possible when the mast 52 is in the retracted position RP. Notably, the recess 96 is shaped complementarily to a shape of the lift-propulsion assembly 60 such that the lift-propulsion assembly 60 is at least partially received in the recess 96 in the retracted position RP of the mast 52. More particularly, the recess 96 has a tunnel portion 150 that is shaped like a tunnel to receive part of the propulsion unit 64 therein, namely a top half of the propulsion unit 64 as can be seen in FIG. 25. The tunnel portion 150 thus is shaped complementarily to the duct 74 of the propulsion unit 64. As shown in FIG. 25, in the retracted position RP of the mast 52, part of the tunnel portion 150 extends in front of the propulsion unit 64 so as to promote flow of water (indicated as flow F) to the propulsion unit 64. In particular, this is helpful to promote the flow of water to the upper half of the propulsion unit 64. The tunnel portion 150 of the recess 96 also extends along both lateral sides of the frame 80 of the lift-propulsion assembly 60 when the mast 52 is in the retracted position RP to form channels in front of the impeller 70. Returning to FIG. 2, the recess 96 further includes a mast portion 152 that opens into the tunnel portion 150 and accommodates the mast 52 therein in its retracted position RP. The mast portion 152 of the recess 96 opens into the chamber 88. The recess 96 also includes a front foil portion 154 and a rear foil portion 155 which are shaped complementarily to the front foil 90 and the rear foil 92 respectively so as to at least partially receive the front foil 90 and the rear foil 92 in the retracted position RP of the mast 52.

It is to be understood that the recess 96 is configured differently in embodiments in which the hydrofoil 62 is shaped or dimensioned differently. For instance, in the embodiment of FIGS. 30 to 32, the recess 96 is shaped differently to accommodate the particular shape and dimensions of the single foil 90'.

Figure 15:
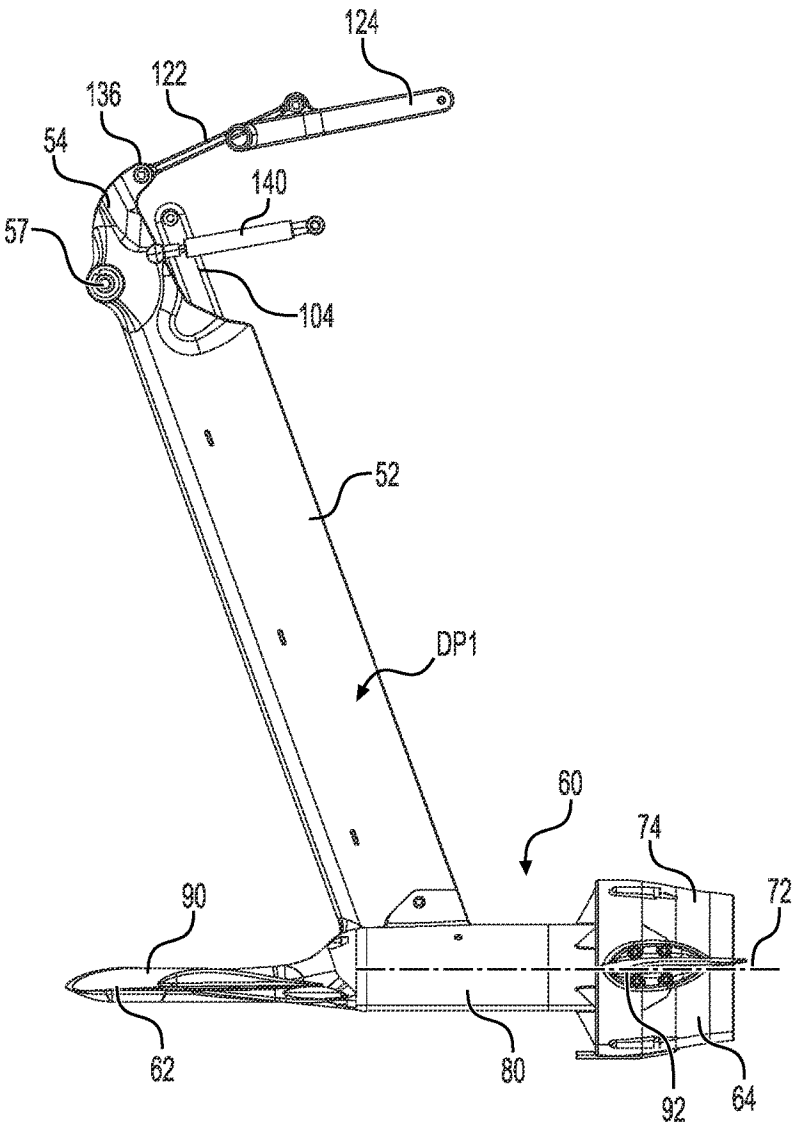
FIG. 15 is a left side elevation view of the part of the retractable lift-propulsion system of FIG. 13.

In this embodiment, the propulsion unit 64 is generally vertically aligned with the foils 90, 92 of the hydrofoil 62 such that the propulsion unit 64 and the foils 90, 92 are located at generally the same depth when the watercraft 10 is in use. For instance, as can be seen, both foils 90, 92 are vertically aligned with the duct 74 of the propulsion unit 64. Moreover, as shown in FIG. 15, the rotating axis 72 of the impeller 70 is approximately vertically aligned with both foils 90, 92. In particular, in this embodiment, the rotating axis 72 of the impeller 70 is vertically aligned with the rear foil 92 and extends slightly vertically higher than the front foil 90.

In other embodiments, as will be described in greater detail further below with reference to FIGS. 33 to 38, the propulsion unit 64 may not be vertically aligned with the hydrofoil 62.

With reference to FIGS. 15 and 16, the lift-propulsion assembly 60 is connected to the mast 52 by the boss 83 of the frame 80 that is pivotally connected to the distal end 56 of the mast 52. As such, the frame 80 is pivotable relative to the mast 52 about a laterally extending frame pivot axis 81. The distal end 56 of the mast 52 extends into an opening of the frame 80 defined at least in part by the boss 83.

With reference to FIGS. 11, 12 and 17, the retractable lift-propulsion system 50 also includes an inner housing 100 that is at least partially enclosed by the buoyant body 12 and is connected thereto. In particular, as shown in FIG. 1, the inner housing 100 is disposed in the chamber 88 behind the electrical assembly 82. When the removable access panel 89 is secured to the buoyant body 12, the inner housing 100 is aligned with the recess 103 of the removable access panel 89 such that a top portion of the inner housing 100, including an upper wall 114 thereof, is exposed. As shown in FIGS. 1 and 3, the inner housing 100 is connected to the buoyant body 12 via two longitudinal braces 118 that are fastened to the inner housing 100. The longitudinal braces 118 are fastened to two lateral braces 120 which are fastened to the buoyant body 12. It is contemplated that the chamber 88 could comprise two distinct sub-chambers in which are located the electrical assembly 82 and the inner housing 100.

Figure 26:
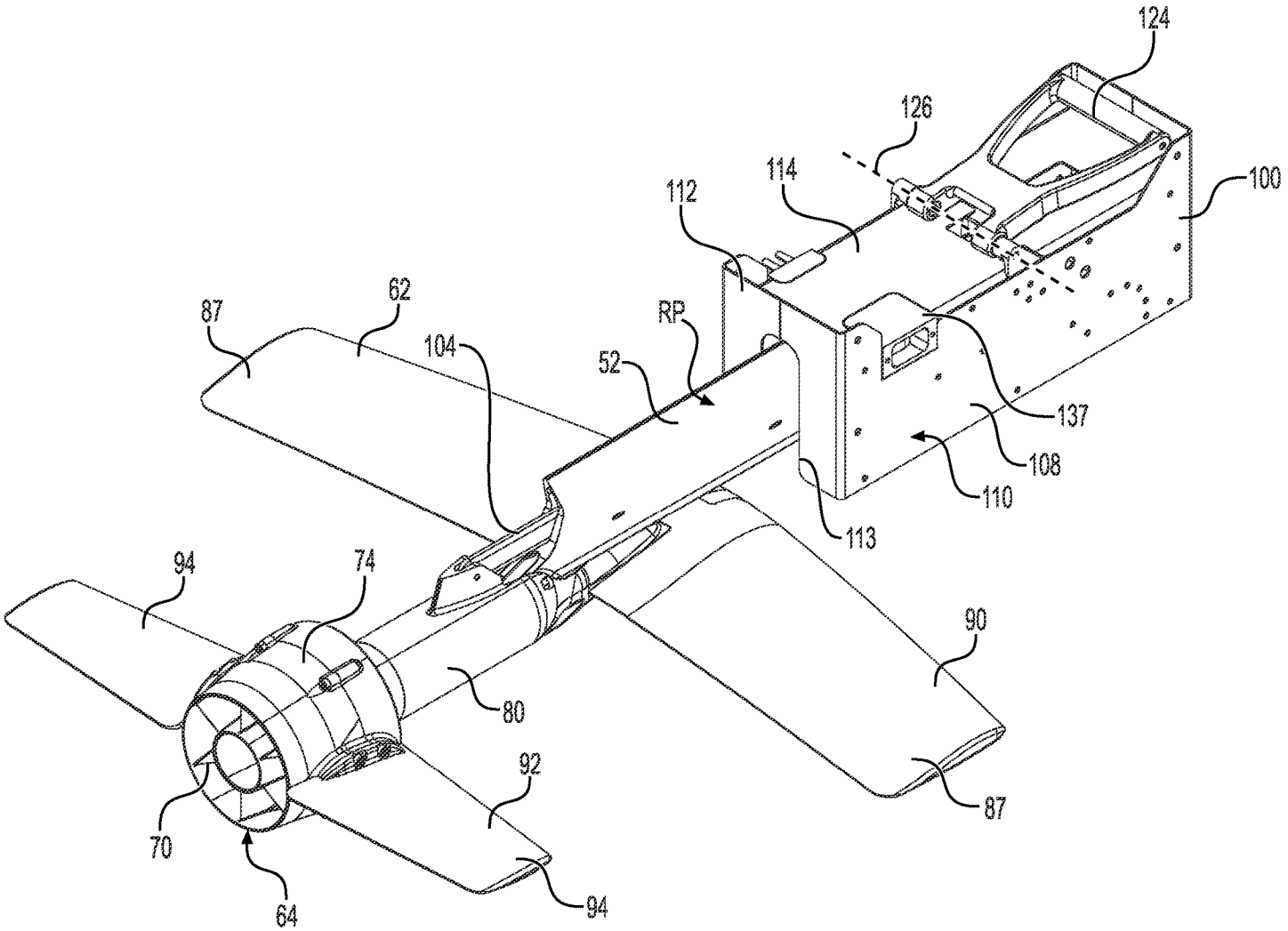
FIG. 26 is a perspective view, taken from a top, rear, right side, of part of the retractable lift-propulsion system of the watercraft of FIG. 20, including the mast, the inner housing and the lift-propulsion assembly.
Figure 29:
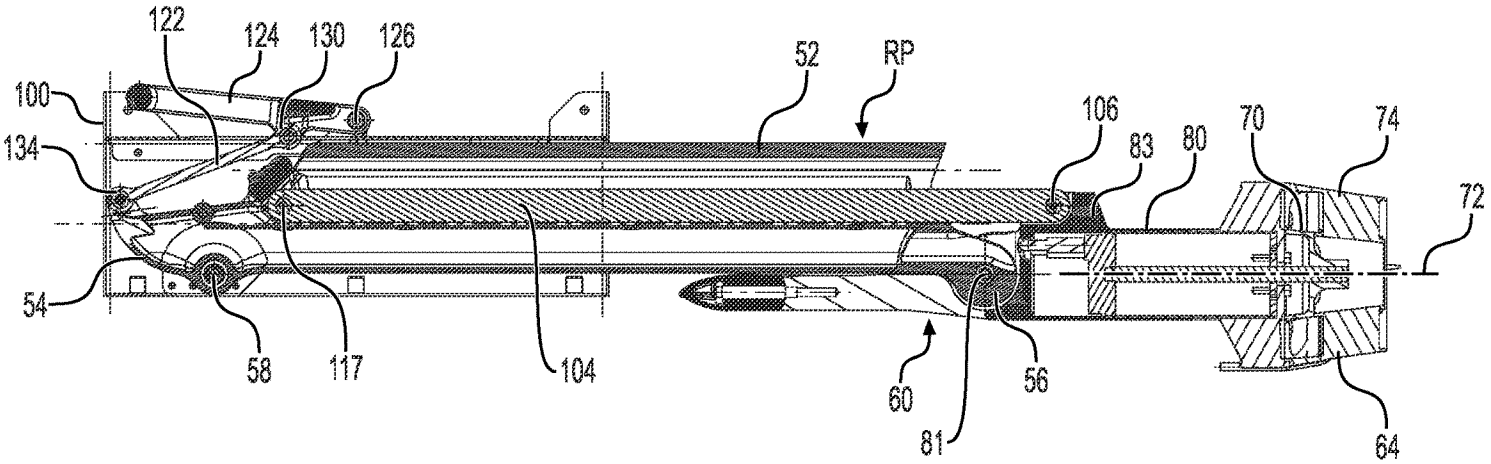
FIG. 29 is a cross-sectional view of the part of the retractable lift-propulsion system of FIG. 26 taken along line 29-29 in FIG. 27.

In this embodiment, the inner housing 100 is generally box-shaped. Notably, the inner housing 100 has left and right lateral walls 108, front and rear walls 109, 112, the upper wall 114 and a lower wall 116. The rear wall 112 defines an opening 113 extending to the lower edge of the rear wall 112. The lower wall 116 defines an opening 115 extending to the rear edge of the lower wall 116. As shown in FIG. 17, the mast 52 extends through the opening 115 defined by the lower wall 116 when the mast 52 is in the fully deployed position DP1 or in the intermediate deployed position DP2. On the other hand, as shown in FIGS. 26 and 29, the mast 52 extends through the opening 113 defined by the rear wall 112 when the mast 52 is in the retracted position RP. The front wall 109 defines an opening (not shown) through which the electrical wires 93 extend from the electrical assembly 88 into the inner housing 100 and to the proximal end 54 of the mast 52.

Figure 27:
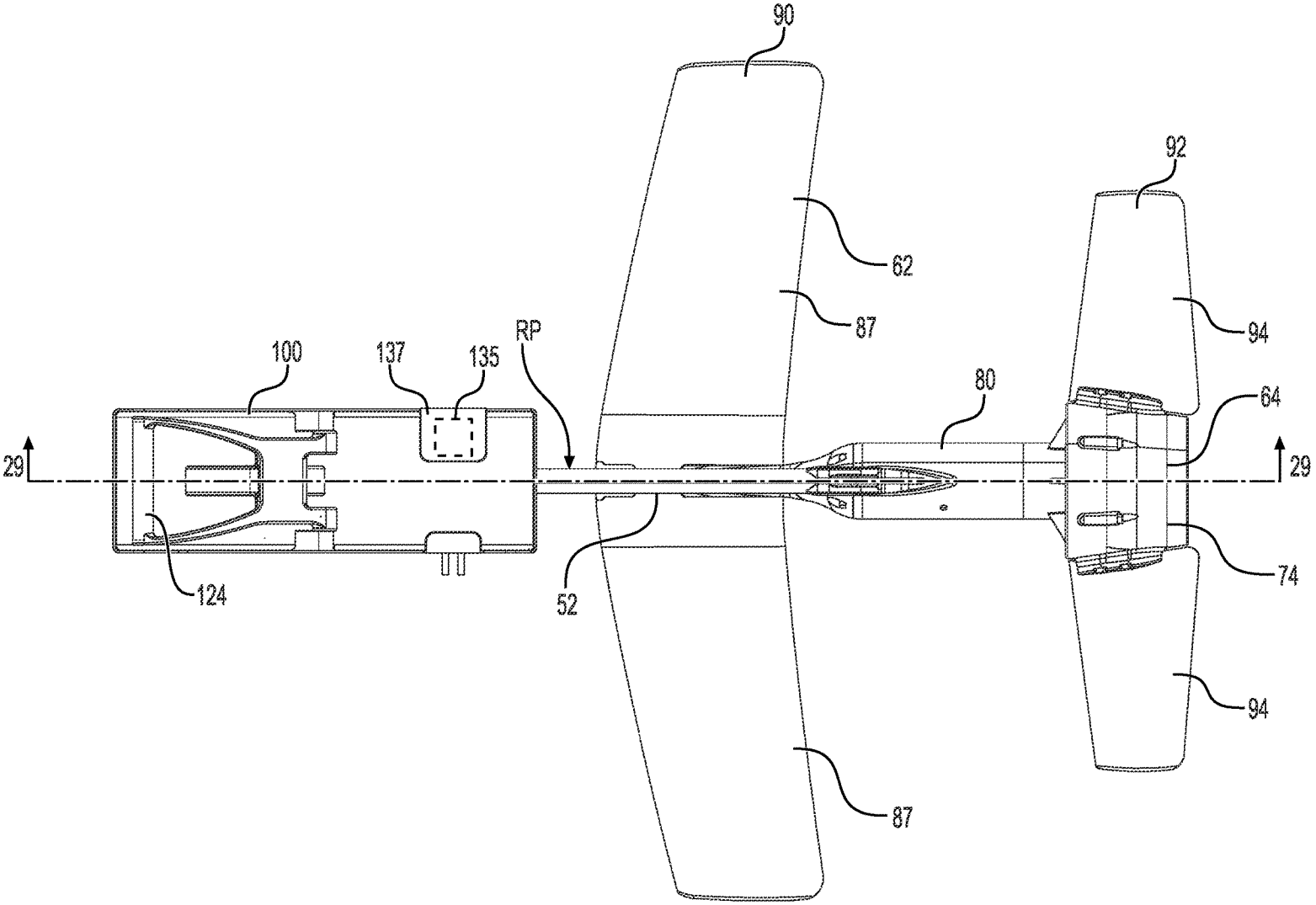
FIG. 27 is a top plan view of the part of the retractable lift-propulsion system of FIG. 26.
Figure 28:
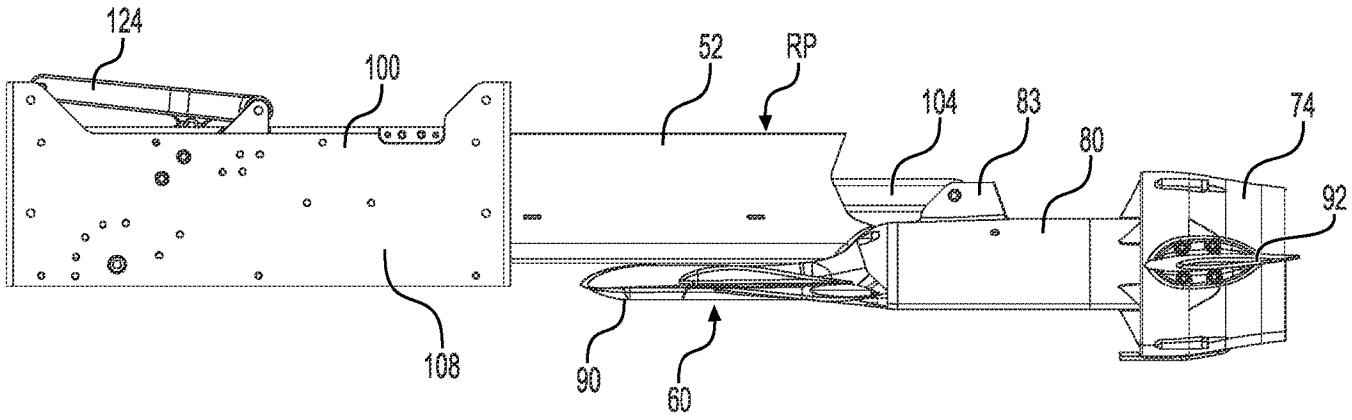
FIG. 28 is a left side elevation view of the part of the retractable lift-propulsion system of FIG. 26.

As shown in FIGS. 12, 17 and 27, a charging plug 135 is provided on the upper wall 114 of the inner housing 100 and is electrically connected to the battery 84. The charging plug 135 can thus be electrically connected to a power source (e.g., an electrical outlet) to charge the battery 84. As shown in FIG. 26, a watertight cover 137 is provided to cover the charging plug 135 to prevent water from coming into contact therewith. As can be seen in FIG. 27, the lever 124 is positioned clear of the charging plug 135 in the retracted position RP of the mast 52.

As mentioned above, the movement of the mast 52, and thus of the lift-propulsion assembly 60 connected thereto, is guided by the mast assembly 110. With reference to FIGS. 16 and 17, the mast assembly 110 includes the mast 52, the inner housing 100, the frame 80, two links 104, 122 and a lever 124. The link 104 extends within the inner space 53 of the mast 52, along the channel 57. Notably, a majority of the link 104 extends through the mast 52 such that, as shown in FIG. 5, when the mast 52 is in the fully deployed position DP1, a portion of the link 104 that extends outside of the buoyant body 12 is fully enclosed within the mast 52. This prevents the link 104 from generating drag when the mast 52 is in the fully deployed position DP1.

Figure 18:
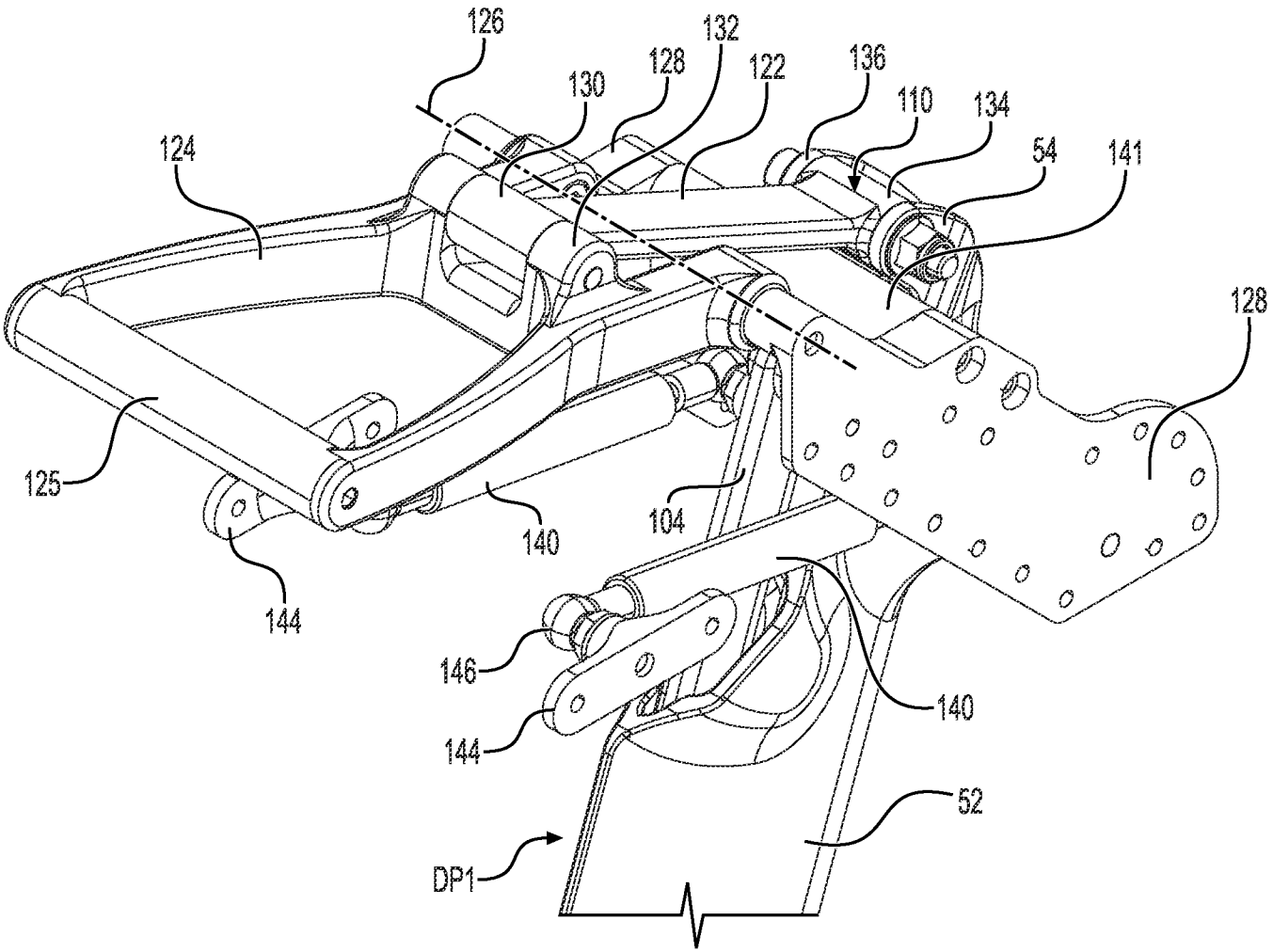
FIG. 18 is a perspective view, taken from a top, rear, right side, of an upper part of the retractable lift-propulsion system of FIG. 11, shown with the inner housing removed to expose components enclosed thereby.

As shown in FIG. 16, a distal end 105 of the link 104 is pivotably connected to the frame 80 about a pivot axis 106 while a proximal end 107 of the link 104 is connected to the inner housing 100 about a pivot axis 117. In particular, as shown in FIGS. 17 and 18, the proximal end 107 of the link 104 is pivotally connected to a cross-member 141 that extends transversely within the inner housing 100. The cross-member 141 is connected between left and right support members 128 (FIG. 18) which are in turn connected to the lateral walls 108 of the inner housing 100.

In this embodiment, the mast 52, the inner housing 100 (including the cross-member 141 and support members 128), the frame 80 and the link 104 form a four-bar linkage. Notably, the pivot axes defined by the pivots between the mast 52, the inner housing 100, the frame 80 and the link 104 are arranged to define the vertices of a parallelogram. This four-bar linkage arrangement of the mast assembly 110 allows the frame 80 to remain in the same orientation throughout the various positions of the mast 52. As such, the lift-propulsion assembly 60 as a whole remains in substantially the same orientation throughout the various positions of the mast 52. For instance, as shown in FIGS. 9, 19 and 25, the rotating axis 72 of the impeller 70 remains in a substantially same orientation relative to the buoyant body 12 throughout movement of the mast 52 between the retracted position RP and the deployed positions DP1, DP2. As will be understood, this allows the lift-propulsion assembly 60 to be used in the retracted position RP and the deployed positions DP1, DP2 of the mast 52 as it remains properly oriented for use.

With reference to FIGS. 1, 3 and 9, the lever 124 is accessible from the upper side 18 of the buoyant body 12, namely through the recess 103 defined by the removable access panel 89. The lever 112 is movable by the operator of the watercraft 10 to correspondingly move the mast 52 between the retracted and deployed positions RP, DP1, DP2, and positions therebetween. In this embodiment, the lever 124 includes a handle 125 for handling by the operator. As shown in FIG. 18, the lever 124 is pivotally connected to the inner housing 100 about a lever pivot axis 126 via the left and right support members 128 that are fastened to the lateral walls 108 of the inner housing 100. The lever 124 is thus pivotable about the lever pivot axis 126 between a front position (shown in FIGS. 25 to 29) corresponding to the retracted position RP of the mast 52, a middle position (shown in FIG. 19) corresponding to the intermediate deployed position DP2 of the mast 52, and a rear position (shown in FIGS. 11 to 18) corresponding to the fully deployed position DP1 of the mast 52. As shown in FIG. 19, in the middle position of the lever 124 (i.e., the intermediate deployed position DP2 of the mast 52), the lever 124 extends through the recess 103 of the removable access panel 89 upwardly from the upper surface 14 of the buoyant body 12.

The link 122 connects the lever 124 to the proximal end 54 of the mast 52. In particular, a proximal end 130 of the link 122 is pivotally connected to a lever link mount 132 of the lever 124 disposed approximately midway between the lever pivot axis 126 and the handle 125, and a distal end 134 of the link 122 is pivotally connected to a mast link mount 136 at the proximal end 54 of the mast 52 at a position offset from the pivot axis 58. Alternatively, in other embodiments, the distal end 134 of the link 122 could be connected to the link 104.

It is contemplated that, in other embodiments, the lever 124 could be replaced by a powered actuator to facilitate actuation of the mast assembly 110. For instance, the powered actuator could be an electric linear actuator, a hydraulic linear actuator (powered by an electric pump) or a rotary actuator (e.g., an electric motor).

As shown in FIG. 17, in the fully deployed position DP1 of the mast 52, the mast link mount 136 and the distal end 134 of the link 122 rest against the cross-member 141 which acts a stopper to prevent the proximal end 54 of the mast 52 from moving rearward of the cross-member 141, both during positioning of the mast 52 to the fully deployed position DP1 and in reaction to forward thrust generated by the impeller 70.

Figure 13:
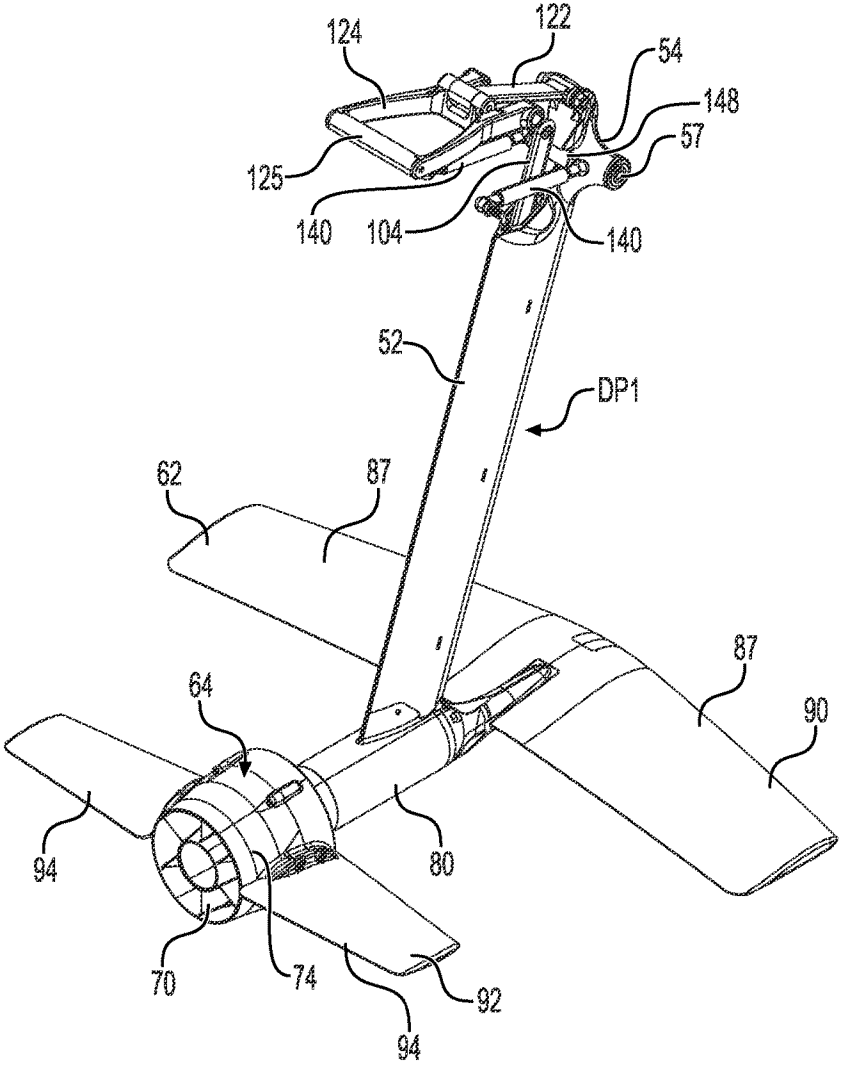
FIG. 13 is a perspective view, taken from a top, rear, right side, of the part of the retractable lift-propulsion system of FIG. 11 with the inner housing omitted to expose components enclosed thereby.
Figure 14:
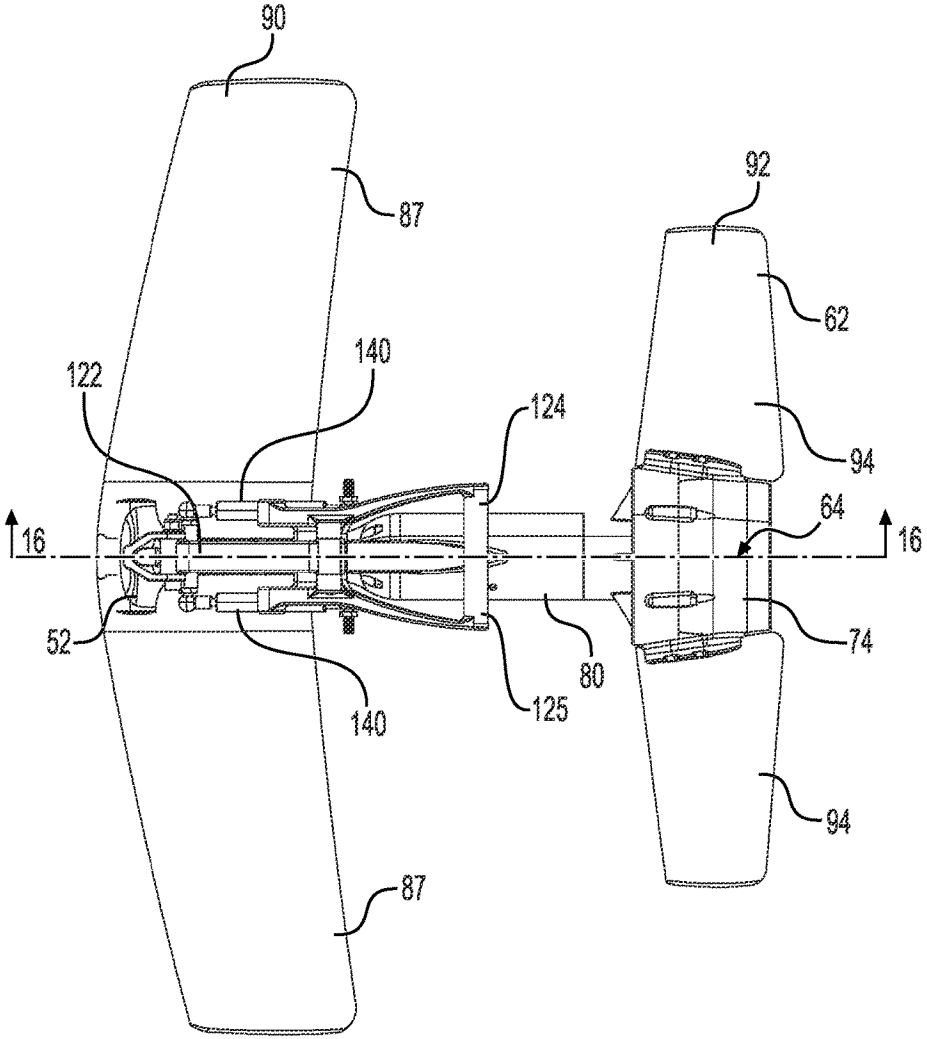
FIG. 14 is a top plan view of the part of the retractable lift-propulsion system of FIG. 13.

As shown in FIGS. 13 and 14, in order to assist in moving the mast 52 from the retracted position RP to the deployed positions DP1, DP2, two gas struts 140 are provided. Each gas strut 140 is connected between the buoyant body 12 and the mast 52. In particular, with reference to FIGS. 13 and 17, a proximal end 142 of each gas strut 140 is pivotally connected to a corresponding strut mount 144 disposed on a corresponding lateral wall 108 of the inner housing 100, and a distal end 146 of each gas strut 140 is pivotally connected to a strut axle 148 extending laterally. The strut axle 148 extends through a recess (not shown) defined by the mast 52 and is retained therein.

With reference to the alternative embodiment of FIGS. 33 to 39, as mentioned above, the propulsion unit 64 may not be vertically aligned with the hydrofoil 62. More specifically, in this alternative embodiment, the propulsion unit 64 is disposed below the hydrofoil 62 such that, in the retracted position RP and deployed positions DP1, DP2 of the mast 52, a distance between the propulsion unit 64 and the lower surface 16 of the buoyant body 12 is greater than a distance between the hydrofoil 62 and the lower surface 16 of the buoyant body 12. For instance, as can be seen, the duct 74 is not vertically aligned with the foil 90'. In particular, the duct 74 is disposed vertically lower than the foil 90'. Notably, the rotating axis 72 of the impeller 70 extends below the foil 90'. For example, the rotating axis 72 extends at least 2 inches below the foil 90'. More specifically, the rotating axis 72 extends between 3 and 4 inches below the foil 90' (e.g., approximately 3.5 inches). While this limits the depth at which the lift-propulsion assembly 60 can be operated, it may also reduce the amount of turbulent flow to the impeller 70 and thus allow more efficient performance of the impeller 70 in the retracted position RP of the mast 52.

Figure 37:
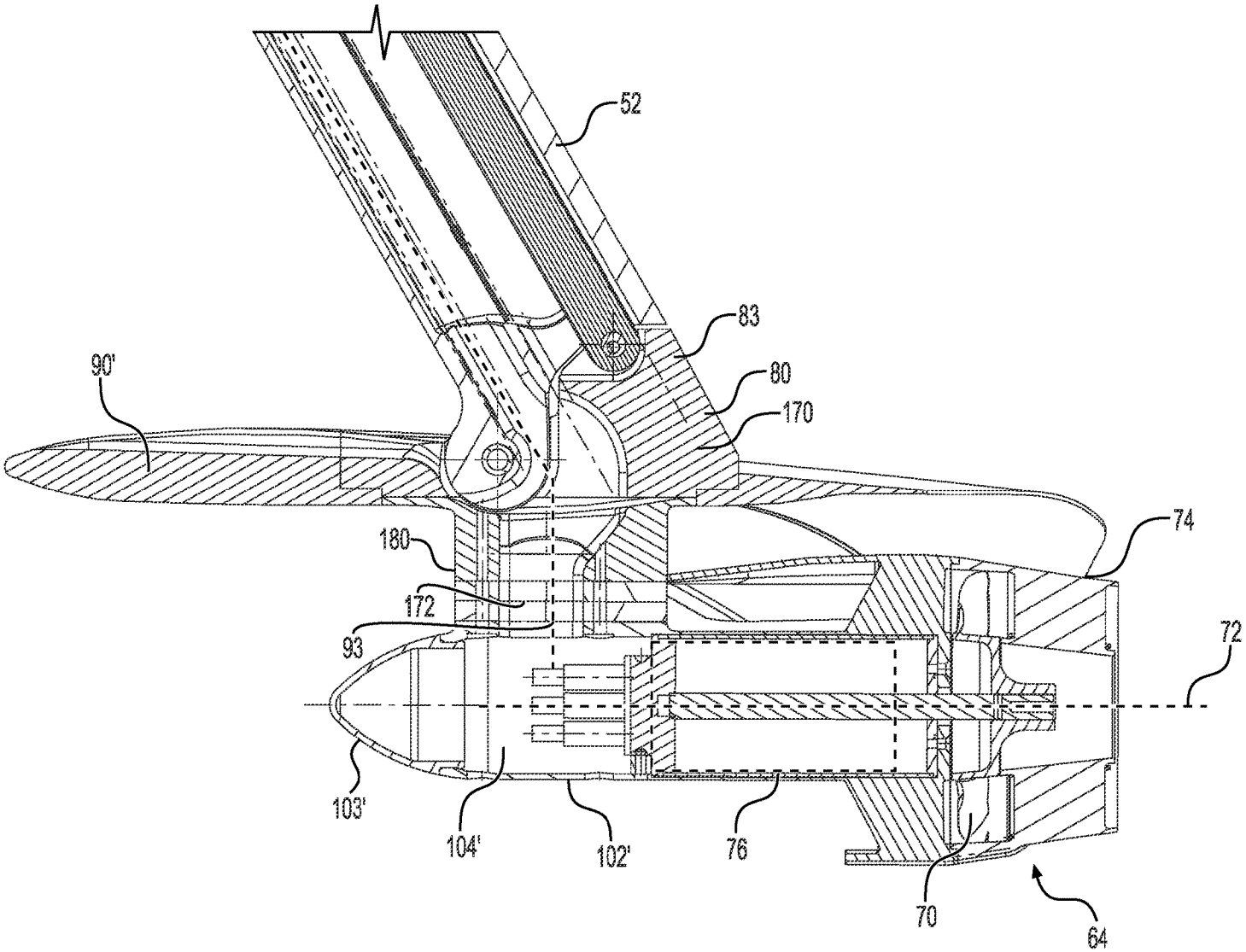
FIG. 37 is a cross-sectional view of the lift-propulsion assembly of the watercraft of FIG. 33.
Figure 38:
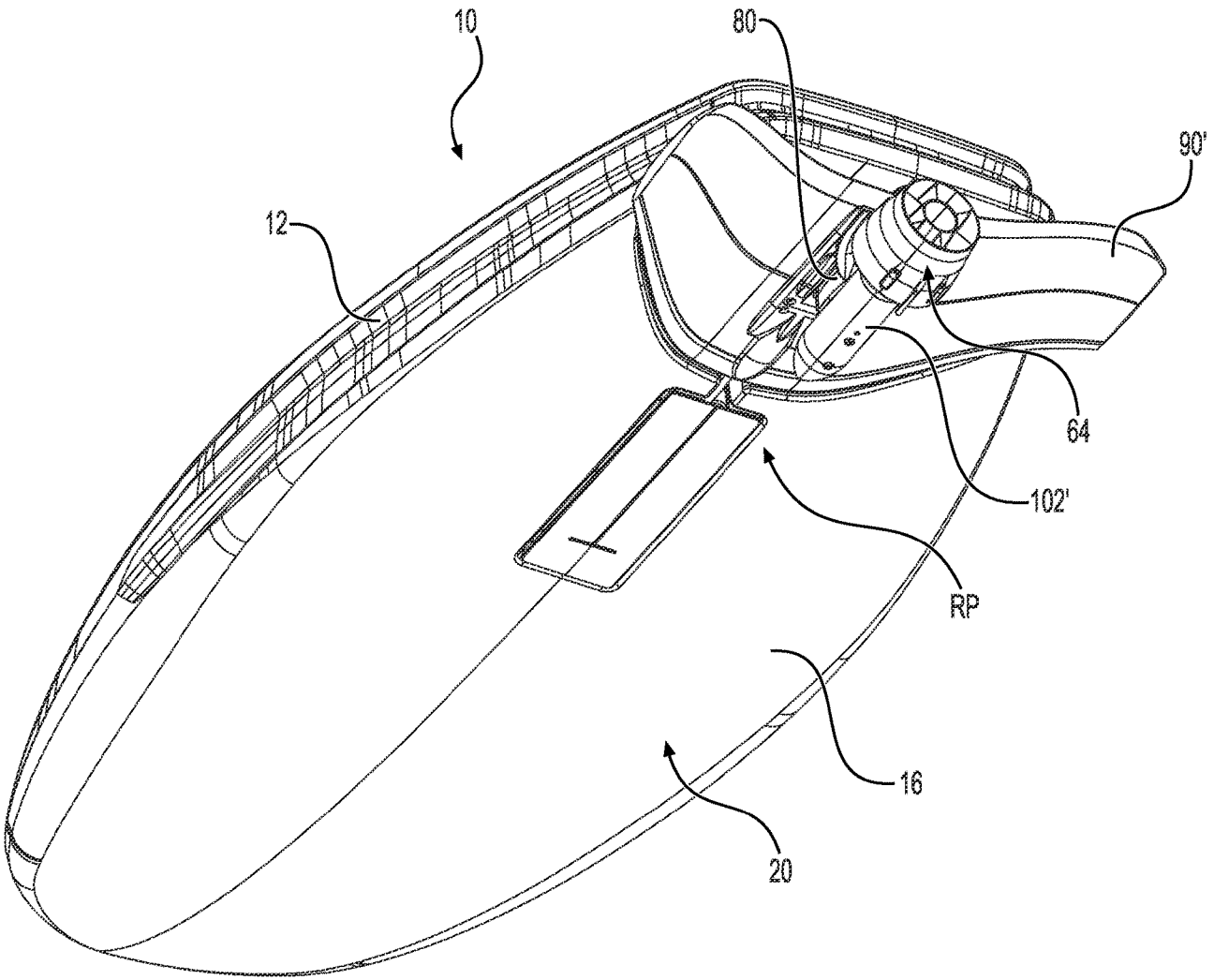
FIG. 38 is a perspective view, taken from bottom, rear, left side, of the watercraft of FIG. 33, with the mast shown in a retracted position.
Figure 39:
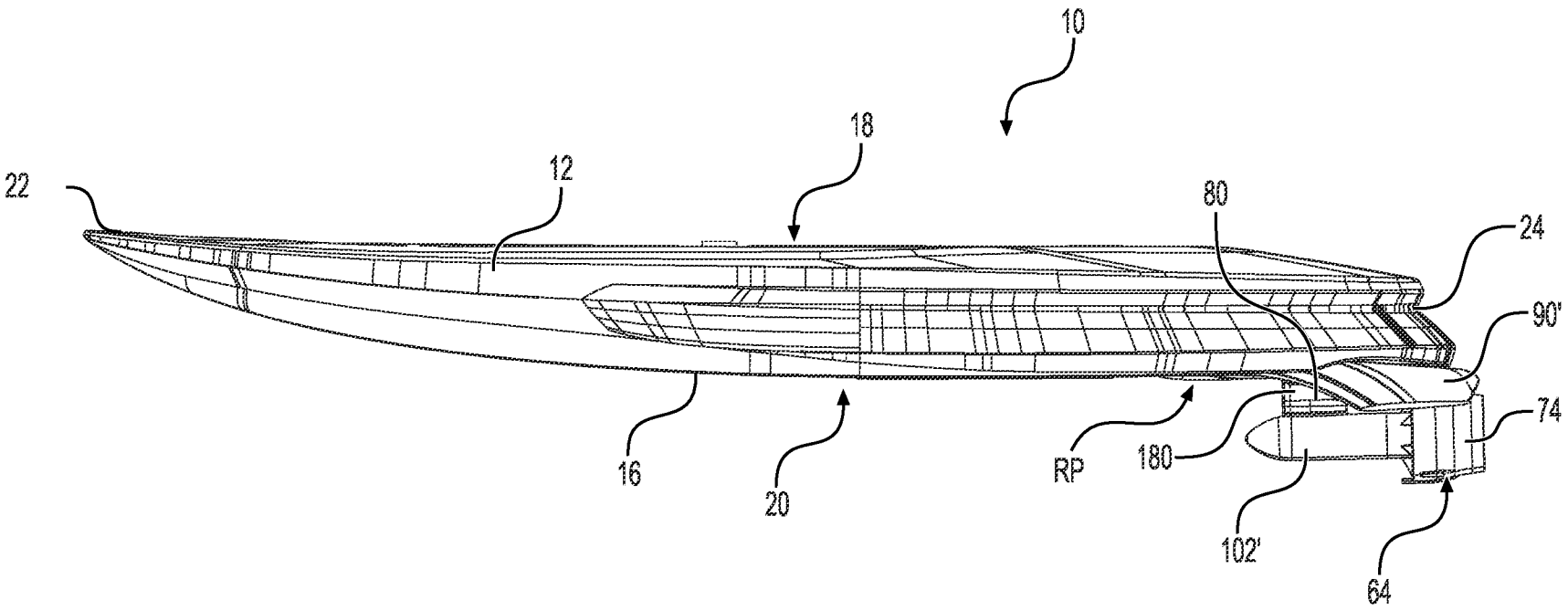
FIG. 39 is a left side elevation view of the watercraft of FIG. 33 with the mast shown in the retracted position.

In this alternative embodiment, as shown in FIG. 37, the frame 80 extends through the foil 90' and includes an upper portion 170 and a lower portion 180. The upper portion 170 includes the boss 83 to which the mast 52 is pivotally connected. The foil 90' is connected to the upper portion 170 of the frame 80. The lower portion 180 extends downwardly from the upper portion 170 and is connected to the motor housing 102'. In particular, the lower portion 180 is a stem extending vertically downward from the upper portion 170. In this embodiment, the frame 80 is hollow, namely defining an interior space 172 defined in part by the upper and lower portions 170, 180 of the frame 80. The interior space 172 is in communication with an interior space 104' defined by the motor housing 102'. As such, the wires 93 extend within the mast 52 as described above, and into the interior space 172 of the frame 80 and into the interior space 104' of the motor housing 102' to connect to the electric motor 76.

While FIGS. 33 to 39 illustrate the hydrofoil 62 including the single foil 90' rather than the two foils 90, 92, it is to be understood that the positioning of the propulsion unit 64 relative to the hydrofoil 62 could also be applied to embodiments in which the hydrofoil 62 includes the front and rear foils 90, 92, such as the embodiment of FIG. 1.

As will be understood from the above, the retractable lift-propulsion system 50 provides a lift-propulsion assembly 60 that is stowable on the watercraft 10 itself, thereby avoiding the operator from having to remove the hydrofoil and propulsion unit from the watercraft 10 as is often the case in conventional hydrofoil-equipped watercraft. Furthermore, the retractable lift-propulsion system 50 allows the operator to quickly and easily deploy the lift-propulsion assembly 60 to operate the watercraft 10 with lift provided by the hydrofoil 62, or to retract the lift-propulsion assembly 60 to use the watercraft 10 as a non-hydrofoil watercraft. This provides greater versatility to the watercraft 10 as it can be operated both in shallow water (when the lift-propulsion assembly 60 is retracted) and in deeper water without removing the lift-propulsion assembly 60 from the watercraft 10. Thus, shallower water locations such as docks or beaches can be navigated with the watercraft 10 despite it being equipped with the hydrofoil 62.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A watercraft, comprising:

a buoyant body having upper and lower surfaces on respective upper and lower sides thereof;

a retractable lift-propulsion system comprising:

a mast connected to the buoyant body, the mast having a proximal end and a distal end, the mast being movable between a retracted position and a deployed position, the mast extending from the lower side of the buoyant body in the deployed position, a distance between the distal end of the mast and the lower surface of the buoyant body being greater in the deployed position than in the retracted position; and a lift-propulsion assembly comprising:

a hydrofoil for providing lift to the watercraft at least in the deployed position of the mast; and a propulsion unit for providing thrust to the watercraft in the retracted and deployed positions of the mast, the lift-propulsion assembly being connected to the distal end of the mast such that, in the deployed position of the mast, the lift-propulsion assembly is distanced from the buoyant body of the watercraft and, in the retracted position of the mast, the lift-propulsion assembly is proximate the buoyant body of the watercraft, the lift-propulsion assembly further comprising a frame pivotably connected to the distal end of the mast, the hydrofoil and the propulsion unit being connected to the frame; and the retractable lift-propulsion system further comprising:

an inner housing at least partially enclosed by and connected to the buoyant body of the watercraft, the mast being pivotably connected to the inner housing; and a mast assembly comprising:

the mast;

the inner housing;

the frame of the lift-propulsion assembly; and a link pivotably connected to the frame of the lift-propulsion assembly and to the inner housing, the mast, the inner housing, the frame and the link collaborating to guide movement of the mast between the retracted and deployed positions.

2. The watercraft of claim 1, wherein the mast pivots between the retracted position and the deployed position.

3. The watercraft of claim 1, wherein the hydrofoil comprises a front foil and a rear foil disposed rearward of the front foil.

4. The watercraft of claim 1, wherein the lift-propulsion assembly further comprises an electric motor for driving the propulsion unit.

5. The watercraft of claim 4, wherein the retractable lift-propulsion system further comprises an electrical assembly supported by the buoyant body, the electrical assembly comprising a battery for powering the electric motor.

6. The watercraft of claim 5, wherein the electric motor is electrically connected to the electrical assembly via wires extending within the mast.

7. The watercraft of claim 5, wherein:

the buoyant body defines a chamber accessible from the upper side of the buoyant body; and the chamber houses the electrical assembly.

8. The watercraft of claim 1, wherein the propulsion unit comprises one of a propeller and an impeller.

9. The watercraft of claim 1, wherein, together, the mast, the inner housing, the frame and the link form a four-bar linkage.

10. The watercraft of claim 1, wherein:

the mast has a cross-sectional profile that is lacrimiform; and the link extends along a channel defined inside the mast.

11. The watercraft of claim 1, wherein the mast assembly further comprises a lever accessible from the upper side of the buoyant body, the lever being movable by an operator of the watercraft to move the mast between the retracted and deployed positions.

12. The watercraft of claim 11, wherein:

the link is a first link; and the mast assembly further comprises a second link connecting the lever to one of the mast and the first link.

13. The watercraft of claim 1, wherein:

the propulsion unit comprises a rotor rotatable about a rotating axis; and the rotating axis remains in a substantially same orientation relative to the buoyant body throughout movement of the mast between the retracted position and the deployed position.

14. The watercraft of claim 4, wherein the retractable lift-propulsion system further comprises a throttle control for use by an operator of the watercraft, the throttle control being in communication with the electric motor to control driving of the propulsion unit by the electric motor.

15. The watercraft of claim 1, wherein, in the retracted position of the mast, at least a majority of the mast is disposed between the upper and lower surfaces of the buoyant body.

16. The watercraft of claim 1, wherein the lift-propulsion assembly is disposed further rearward in the retracted position of the mast than in the deployed position of the mast.

17. The watercraft of claim 1, wherein:

the deployed position is a first deployed position;

the mast is movable between the retracted position, the first deployed position and a second deployed position;

the mast extends from the lower side of the buoyant body in the first deployed position and the second deployed position;

the distance between the distal end of the mast and the lower surface of the buoyant body is greater in the first deployed position than in the second deployed position;

the hydrofoil provides lift to the watercraft at least in the first deployed position and the second deployed position of the mast; and the propulsion unit provides thrust to the watercraft in the retracted position, the first deployed position and the second deployed position of the mast.

18. The watercraft of claim 17, wherein:

the propulsion unit comprises a rotor rotatable about a rotating axis; and the rotating axis remains in a substantially same orientation relative to the buoyant body throughout movement of the mast between the retracted position, the first deployed position and the second deployed position.

19. The watercraft of claim 1, wherein the propulsion unit is disposed below the hydrofoil such that, in the retracted and deployed positions of the mast, a distance between the propulsion unit and the lower surface of the buoyant body is greater than a distance between the hydrofoil and the lower surface of the buoyant body.

20. The watercraft of claim 1, wherein the watercraft is a board.

* * * * *